US006724133B2

(12) United States Patent
Miyashita et al.

(10) Patent No.: US 6,724,133 B2
(45) Date of Patent: Apr. 20, 2004

(54) SPARK PLUG WITH NICKEL ALLOY ELECTRODE BASE MATERIAL

(75) Inventors: Naomichi Miyashita, Aichi (JP); Yoshihiro Matsubara, Mie (JP); Wataru Matsutani, Aichi (JP); Masayuki Segawa, Aichi (JP); Hiroaki Kuki, Aichi (JP); Mamoru Musasa, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 70 days.

(21) Appl. No.: 09/953,173

(22) Filed: Sep. 17, 2001

(65) Prior Publication Data

US 2002/0079800 A1 Jun. 27, 2002

(30) Foreign Application Priority Data

Sep. 18, 2000 (JP) ..... 2000-282396
Jul. 19, 2001 (JP) ..... 2001-220531

(51) Int. Cl.[7] ..... H01T 13/20
(52) U.S. Cl. ..... 313/143; 313/141; 313/142
(58) Field of Search ..... 313/141, 142, 313/143, 123, 136, 140

(56) References Cited

U.S. PATENT DOCUMENTS 4,514,657 A * 4/1985 Igashira et al. ..... 313/130
5,448,130 A * 9/1995 Matsutani et al. ..... 313/141
5,461,276 A * 10/1995 Matsutani et al. ..... 313/141
5,497,045 A * 3/1996 Matsutani et al. ..... 313/141
5,563,468 A * 10/1996 Abe et al. ..... 313/141
5,574,329 A * 11/1996 Kagawa ..... 313/141
6,121,719 A * 9/2000 Matsutani et al. ..... 313/141
6,316,868 B1 * 11/2001 Ishino et al. ..... 313/141

FOREIGN PATENT DOCUMENTS

JP 63 018 033 A 1/1988
JP 63 118 040 A 5/1988
JP 03 111 534 A 5/1991
JP 07 268 522 A 10/1995
JP 09 287 041 A 11/1997
JP 10 251 787 A 9/1998

* cited by examiner

*Primary Examiner*—Vip Patel
*Assistant Examiner*—Kevin Quarterman
(74) *Attorney, Agent, or Firm*—Sughrue Mion, PLLC

(57) ABSTRACT

A spark plug having a center electrode 2 formed from an electrode base material 2*n*, which is made of an Ni alloy containing an alloy component (e.g., Cr) capable of forming an oxide semiconductor having a resistivity of negative temperature coefficient. Thus, a corrosion suppression layer originating from the components of the electrode base material is formed on the surface of a tip end portion of the insulator 3, so that corrosion (channeling) of the surface of the tip end portion of the insulator 3 due to creeping spark discharge can be effectively suppressed. In addition, when the constituent metal of the electrode base material 2*n* has a coefficient of thermal conductivity of 17 to 30 W/m·K, the heat transfer performance of the electrode is enhanced, so that durability against electrode consumption can be greatly improved.

32 Claims, 9 Drawing Sheets

SPARK PLUG WITH NICKEL ALLOY ELECTRODE BASE MATERIAL

BACKGROUND OF THE INVENTION

1. Field of the Invention

The present invention relates to a spark plug for an internal combustion engine.

2. Description of the Related Art

Recently, with improvement of engine performance, spark plugs are required to have further extended service life and further improved resistance to contamination. For example, a so-called creeping discharge spark plug is a spark plug for an internal combustion engine having improved contamination resistance. The creeping discharge spark plug is configured such that a spark generated at a spark discharge gap propagates along a surface of an insulator; i.e., in the form of creeping discharge, at all times or depending on particular conditions. A semi-creeping discharge spark plug, which is one type of the creeping discharge spark plug, includes a center electrode, an insulator surrounding the center electrode, and a ground electrode having at its end a discharge surface, which is disposed to face a side surface of the center electrode. The tip end portion of the insulator is disposed to have a positional relationship with the center electrode and the ground electrode such that the end portion of the insulator is located between the center electrode and the discharge surface of the ground electrode (i.e., located in the spark discharge gap). In such a semi-creeping discharge spark plug, when a spark travels along the tip end surface of the insulator, aerial discharge occurs between the surface of the insulator and the discharge surface at the tip end of the ground electrode.

When a spark plug is used for a long period of time at a low temperature not higher than 450° C.; for example, during predelivery, the spark plug becomes "sooted" or "covered with fuel." In such a state, the insulator surface is covered with a conductive contaminant, such as carbon, which causes defective operation. However, in the case of the above-described creeping discharge spark plug, while spark discharge creeps across the surface of the insulator, an adhering contaminant is burned off at all times, and thus the creeping discharge spark plug exhibits improved resistance to contamination as compared with a parallel-electrode-type spark plug.

Meanwhile, such a creeping discharge spark plug involves frequent occurrence of a spark which creeps across the surface of an insulator, and thus tends to suffer so-called channeling, or a phenomenon whereby the surface of an insulator is abraded and grooves are formed on the surface. Progress of channeling is apt to impair heat resistance or reliability of a spark plug, and channeling is particularly apt to occur during high-speed or heavy-load operation. With the recent trend toward high engine output, there has been demand for spark plugs of excellent durability, and a requirement for prevention or suppression of channeling is becoming stricter.

In some cases, the center electrode of a spark plug is formed of an Ni-base heat-resistant alloy in order to improve heat resistance. However, since the Ni-base heat-resistant alloy contains a relatively large amount of a secondary component such as Cr or Fe, thermal conductivity decreases considerably, depending on the composition. As a result, the heat-transfer performance of the electrode is lowered with resultant acceleration of consumption of the electrode or consumption of a noble-metal discharge portion formed on the electrode. Thus, when the spark plug is used in an environment in which the electrode temperature is prone to rise; i.e., during high-speed, heavy-load operation, the service life of the plug is shortened.

SUMMARY OF THE INVENTION

It is therefore an object of the present invention to provide a spark plug whose center electrode has improved heat-transfer performance, which has improved durability against electrode consumption and excellent contamination resistance, and which hardly causes channeling.

In order to achieve the above object, the present invention provides a spark plug of a first structure comprising:

a center electrode:

an insulator surrounding the center electrode; and a ground electrode positioned relative to a tip end portion of the insulator and a tip end portion of the center electrode such that a spark discharge gap is formed between the ground electrode and the tip end portion of the center electrode, and creeping spark discharge along a surface of the tip end portion of the insulator can occur at the spark discharge gap, wherein an electrode base material which forms at least a surface layer portion of the center electrode is made of an Ni alloy having a coefficient of thermal conductivity of 17 to 30 W/m·K, the Ni alloy containing Ni as a predominant component and an element (hereinafter referred to as an "NTC element"), as a secondary component, which element can form an oxide semiconductor having a resistivity of negative temperature coefficient (hereinafter also referred to as an "NTC oxide semiconductor").

When the center electrode is formed of an Ni alloy containing an NTC element as a secondary component and having a coefficient of thermal conductivity falling within the above-described range, a layer containing an NTC oxide semiconductor and serving as a corrosion suppression layer is easily formed on the surface of the tip end portion of the insulator. Thus, corrosion of the surface of the tip end portion of the insulator due to creeping spark discharge can be suppressed effectively, and the electrode can have improved heat transfer property, so that durability in terms of electrode consumption can be greatly improved.

The above-described corrosion suppression layer decreases the discharge voltage at the spark discharge gap. When this effect is utilized, suppression of consumption of the electrode (or a noble-metal consumption-resistant portion formed on the electrode) and further reduction of channeling can be attained. Moreover, in order to enable creeping spark discharge, the shortest distance between the insulator and the ground electrode is preferably made shorter than the shortest distance between the center electrode and the ground electrode.

In the first structure of the present invention, two or more ground electrodes can be disposed around the center electrode. This configuration enables sparks to be generated at positions distributed along the circumference of the insulator, and therefore is advantageous in suppressing formation of deep channels.

The spark plug having the first structure according to the present invention may be embodied as follows. That is, a plurality of ground electrodes are disposed around the center electrode; and at least one ground electrode among them is a semi-creeping ground electrode which is disposed such that its end surface faces a side surface of the center electrode, while at least a portion of the tip end portion of the insulator is interposed therebetween to thereby form a semi-creeping discharge gap between the end surface of the semi-creeping ground electrode and the side surface of the center electrode. In this structure, since the end surface of the ground electrode and the side surface of the center electrode face each other, while sandwiching at least a portion of the tip end portion of the insulator, creeping spark discharge along the surface of the insulator occurs more frequently, so that the spark plug can have excellent contamination resistance. In conventional spark plugs, the above-described structure is not necessarily desirable from the viewpoint of suppression of channeling of the insulator. However, in the present invention, since the center electrode is made of an Ni alloy containing the above-described NTC element as a secondary component as described above, a spark plug can be realized which exhibits excellent channeling resistance even when creeping spark discharge frequently occurs. Further, the distance E between the tip end surface of the insulator and the rear-side edge of the end surface of the ground electrode; i.e., the distance of overlap between the tip end surface of the ground electrode (semi-creeping ground electrode) and the side surface of the tip end portion of the insulator along the axis of the center electrode, is preferably set to 0.2 mm or more. In this case, the effect of the insulator 3 for blocking a discharge passage and thus the channeling suppressing effect become more remarkable.

In the above-described structure, one of the plurality of ground electrodes may be a parallel ground electrode which is disposed such that a side surface of a tip end portion of the ground electrode faces, in parallel, the tip end surface of the center electrode to thereby form a parallel aerial discharge gap. In this case, a parallel aerial discharge gap similar to that found in a so-called parallel electrode spark plug is formed between the side surface of a tip end portion of the parallel ground electrode and the tip end surface of the center electrode; and a semi-creeping discharge gap is formed between the tip end surface of the semi-creeping ground electrode and the side surface of the center electrode. When the size of the parallel aerial discharge gap is rendered greater than that of the semi-creeping discharge gap, sparks are generated more easily at the parallel aerial discharge gap in an ordinary state; and when the tip end surface of the insulator is contaminated, sparks are generated more easily at the semi-creeping discharge gap. Sparks concentrate at the parallel aerial discharge gap to a high degree, and the frequency of spark discharge at a projected position is high. Therefore, ignition performance can be further enhanced.

The spark discharge gap having the first structure according to the present invention may be embodied as follows. That is, a center electrode is disposed in an insulator such that a tip end portion of the center electrode projects from the insulator; and a cylindrical metallic shell is provided to surround the insulator. A base end portion of a ground electrode is welded to an end portion of the metallic shell; and a tip end portion of the ground electrodes is bent toward the center electrode such that an end surface of the ground electrode faces a side surface of the projecting tip end portion of the center electrode to thereby form a first gap, and an inner surface of the tip end portion of the ground electrode faces the tip end surface of the insulator to thereby form a second gap, which is smaller than the first gap. The spark plug is of a so-called intermittent creeping discharge type. Before contamination does not considerably proceed, spark discharge occurs at the first gap, which is advantageous from the viewpoint of ignition performance; and when contamination has proceeded, the resistivity of the surface of the insulator decreases, and spark discharge at the second gap starts. In other words, the progress of contamination at the surface of the insulator is detected automatically, and intermittent spark discharge is caused to occur at the second gap, so that contaminant deposit is burnt out. Thus, a creep discharge spark plug is realized which has excellent contaminant resistance, while maintaining ignition performance at the time of ordinary spark discharge. Moreover, since sparks are not produced by means of creeping discharge at all times, the above-described configuration is advantageous from the viewpoint of channeling suppression.

In the above-described structure, as shown in FIG. 5, when the side, with respect to the axis of the center electrode, on which the tip end surface of the center electrode is located is referred to as the front side, and the side opposite the front side is referred to as the rear side, the distance h between the rear-side edge of the end surface of the ground electrode and the tip end surface of the insulator as measured along the axial direction is preferably set to 0.3 mm or more. The distance h determines the size of the second gap g2 for creeping discharge. When the distance h is set to a relatively large value, the channeling resistance can be improved further. However, when the distance h exceeds 0.7 mm, the discharge voltage at the second gap becomes excessively high, and the function as an intermittent creeping discharge spark plug becomes insufficient in some cases. Therefore, the distance h is preferably set to 0.7 mm or less. More preferably, the distance h is adjusted within the range of not less than 0.4 mm.

In the creeping discharge spark plug having the above-described first structure, the difference d−D between the outer diameter D of the center electrode and the diameter of the through hole, into which the center electrode is inserted, is preferably set to 0.07 mm or more as measured at a position separated from the tip end of the insulator by 5 mm as measured along the axial direction. The reason will be described below.

The present inventors consider that a corrosion suppression layer is formed through the mechanism as described below. That is, upon generation of spark discharge, gas molecules in the vicinity of the spark discharge gap are ionized; and the thus-produced ions accelerate and hit the discharge surface of the electrode due to a gradient of electrical field created in the gap, so that the metal components of the electrodes are sputtered. The thus-sputtered metal components become oxides immediately and deposit on the surface of the insulator. The deposited oxides form a corrosion suppressing layer.

All of the reaction product formed through oxidation of sputtered metal components does not necessarily contribute to formation of the corrosion suppression layer. A portion of the reaction product accumulates in the clearance between the center electrode and the through hole of the insulator as dust. Further, portions cut from the corrosion suppression layer may enter and accumulate in the clearance as dust. In either case, when the clearance is small, generated dust accumulates in the clearance and fills the clearance densely. In such a case, upon repetition of heating/cooling cycles, the insulator may crack due to difference in thermal expansion between the center electrode made of metal and the insulator made of ceramic.

However, through intensive studies, the present inventors found that when a clearance which is represented by the difference between the outer diameter of the center electrode and the diameter of the through hole of the insulator is set to 0.07 mm or more, dust is prevented from densely filling the clearance. That is, even when dust generated during formation of the corrosion suppression layer enters the clearance between the center electrode and the insulator, the insulator does not crack when subjected to repeated heating/cooling cycles. The reason why the size of the clearance is defined at a position separated from the tip end of the insulator by 5 mm as measured along the axial direction is as follows. That is, the spark plug is typically attached to a cylinder head such that the spark discharge gap; i.e., the tip end of the insulator, faces downward. The dust generated due to formation of the corrosion suppression layer enters the clearance, while being pressed upward by means of combustion pressure. Meanwhile, creeping discharge sparks enter the interior of the insulator. Therefore, the center electrode is consumed in a region to which the sparks reach. As a result, dust present at a position at which the center electrode is hardly consumed and to which influence of heating and cooling reaches easily; i.e., at a position separated from the tip end of the insulator by about 5 mm, is likely to receive the influence of the heating/cooling cycles. Meanwhile, in some cases, the corrosion suppression layer is partially removed by means of creeping discharge sparks, and a phenomenon similar to channeling may occur. Notably, in the above-described spark plug of the present invention, since a reaction product produced through oxidation of sputtered metal components deposits on the removed portion of the corrosion suppression layer to thereby restore it, channeling hardly proceeds to the insulator portion.

Notably, the strength of attack of creeping discharge spark against the insulator; i.e., easiness of occurrence of channeling, changes depending on the polarity of voltage applied to the electrodes for producing spark discharge. Especially, applying voltage for spark discharge such that the center electrode assumes a positive polarity is more advantageous in suppressing channeling than is applying voltage such that the center electrode assumes a negative polarity. When voltage is applied to the electrode such that the center electrode assumes a negative polarity, as described above, the difference d−D between the outer diameter D of the center electrode and the diameter of the through hole, into which the center electrode is inserted, is preferably set to 0.07 mm or more as measured at a position separated from the tip end of the insulator by 5 mm as measured along the axial direction. By contrast, when voltage is applied to the electrode such that the center electrode assumes a positive polarity, only a small amount of dust is generated due to its channeling suppressing effect, and therefore, the difference d−D can be set to 0.03 mm or more (preferably, 0.04 mm or more).

The Ni alloy which forms the electrode base material of the center electrode contains any of Cr, Fe, Cu, Zn, Ti, Ru, V, Co, Nb and Ta as the above-described NTC element. When the above-described NTC oxide semiconductor is formed from these elements, their ionic radiuses become relatively small, so that these elements can easily diffuse and penetrate into the surface of the insulator made of alumina. Thus, the boding strength of the formed corrosion suppression layer is increased, which is effective for stably maintaining the effect of suppressing corrosion against the insulator and the channeling prevention effect.

The above-described effects become remarkable when at least one of Cr, Fe and Cu is employed as an NTC element. In this case, the constituent metal (Ni alloy) of the electrode base material preferably contains Cr; specifically, the Cr content of the Ni alloy is adjusted within a range of 1.5 to 9% by mass. When the Cr content is less than 1.5% by mass, the effect of reducing discharge voltage cannot be attained in some cases. Moreover, when the above is applied to a creeping discharge spark plug, the corrosion suppression function of the layer formed on the surface of the insulator becomes insufficient, so that the channeling prevention effect becomes insufficient. When the Cr content exceeds 9% by mass, the coefficient of thermal conductivity cannot be increased to 17 W/m·K or higher in some cases. Cr and Fe are more advantageous than other NTC elements, because Cr and Fe can improve the high-temperature strength of the Ni alloy, to thereby achieve simultaneously high-temperature electrode durability and prevention of channeling of the insulator.

The effect of improving the heat transfer property of the electrode can be obtained not only in creeping discharge spark plugs which involve a channeling problem, but also in spark plugs in which creeping discharge along the surface of the insulator does not occur in an ordinary state; e.g., a so-called parallel electrode spark plug in which one side surface of the ground electrode faces the tip end surface of the center electrode.

That is, the present invention provides a spark plug of a second structure comprising:

a center electrode having, at its tip end portion, a consumption-resistant portion made of a noble metal or a composite material containing the noble metal as a predominant component;

an insulator disposed to surround the center electrode; and a ground electrode disposed such that a side surface of a tip end portion of the ground electrode faces, in parallel, a tip end surface of the center electrode, to thereby form a parallel aerial discharge gap, wherein an electrode base material, which forms at least a surface layer portion of the center electrode, is formed of an Ni alloy which contains Ni as a predominant component and Cr in an amount of 1.5 to 9% by mass as a secondary component, and has a coefficient of thermal conductivity of 17 to 30 W/m·K. In this structure, a layer formed on the surface of the insulator does not necessarily participate in suppression of corrosion such as channeling (in the present specification, for the sake of convenience, the layer may be referred to as "corrosion suppression layer" in such a case).

In the above-described structure, when the Cr content of the Ni alloy which forms the electrode base material is less than 1.5% by mass, the oxidation resistance of the electrode base material becomes insufficient, so that a crack stemming from oxidation of the electrode base material is likely to be generated at the junction interface (e.g., welding interface) between the electrode base material and the consumption-resistant portion made of a noble metal and provided at the tip end portion of the center electrode, so that separation of the consumption-resistant portion occurs easily. When the Cr content exceeds 9% by mass, an excessively thick layer containing the NTC semiconductor oxide is formed on the surface of the insulator, so that the resistivity of the surface of the insulator decreases. As a result, sparks are produced at locations other than the regular spark discharge gap; e.g., sparks (so called lateral sparks) are likely to be produced between the side surface of the insulator and the inner circumferential surface of the metallic shell.

In the above-described two structures for spark plugs, the coefficient of thermal conductivity of the constituent metal (Ni alloy) of the electrode base material is set to 17 W/m·K or higher, because when the coefficient of thermal conductivity is less than 17 W/m·K, the thermal transfer performance of the electrode deteriorates, and thus durability in terms of electrode consumption cannot be secured. Further, the coefficient of thermal conductivity is limited to not greater than 30 W/m·K, because when the coefficient of thermal conductivity is to be increased beyond 30 W/m·K, the Ni content of the Ni alloy must be increased, with the result that the discharge-voltage-decreasing effect or insulator-corrosion-suppressing effect of the layer which originates from the electrode base material and formed on the surface of the insulator becomes insufficient. In view of the above, the Cr content of the Ni alloy is preferably set within the above-described range, more preferably in the range of 2 to 5% by mass.

More preferably, the electrode base material is made of a material which contains Fe in an amount of 1 to 5% by mass. Use of such material further improves the insulator-corrosion-suppressing effect or discharge-voltage-decreasing effect of a formed corrosion suppression layer. The formed corrosion suppression layer contains both Fe and Cr. When the Fe content of the Ni alloy exceeds 5% by mass, the coefficient of thermal conductivity is likely to deviate from the above-described range. When the Fe content of the Ni alloy is less than 1% by mass, the effect obtained through addition of Fe cannot be attained sufficiently. The total content of Fe and Cr is preferably set to 2 to 9% by mass.

Preferably, the Ni alloy which constitutes the electrode base material contains Cr as an essential component and at least one of Fe and Cu as an additional component. In this case, a formed corrosion suppression layer contains Cr as an essential component and at least one of Fe and Cu as an additional component. Cr is an element necessary for securing oxidation resistance of the electrode base material and stabilization of the corrosion suppression layer. Fe and Cu are effective in decreasing discharge voltage. In this case, more preferably, the Ni alloy contains as secondary components Fe in an amount of 1% by mass or more and Cr in an amount of 1.5% by mass or more. When the Fe content is less than 1% by mass, the discharge-voltage-decreasing effect becomes poor, with the result that capacitive discharge voltage increases, and sufficient channeling suppressing effect cannot be expected. When the Cr content is less than 1.5% by mass, the oxidation resistance of the electrode base material and the effect of stabilizing the corrosion suppression layer cannot be secured sufficiently. In this case, the total content of Fe and Cr is preferably set to 2.5 to 9% by mass.

From the viewpoint of suppressing oxidation of the Ni alloy which constitutes the electrode base material, the Cr content is preferably made higher than the Fe content (although the Fe content can be set to 0% by mass, the Ni alloy desirably contains Fe in order to decrease discharge voltage as described above). In this case, more desirably, the ratio of Cr content WCr (% by mass) to Fe content WFe (% by mass), WCr/WFe, is 2 or greater.

Even when the Ni alloy which constitutes the electrode base material of the center electrode contains as a secondary component at least one element selected from among Ru, Zn, V, Co, Nb, Ta and Ti, through formation of a corrosion suppression layer on the surface of the insulator, a channeling suppressing effect can be attained in a similar manner.

The present invention further provides a spark plug of a third structure comprising:

a center electrode:

an insulator disposed to surround the center electrode; and a ground electrode disposed relative to a tip end portion of the insulator and a tip end portion of the center electrode such that a spark discharge gap is formed between the ground electrode and the tip end portion of the center electrode, and creeping spark discharge along a surface of the tip end portion of the insulator can occur at the spark discharge gap, wherein an electrode base material which forms at least a surface layer portion of the center electrode is made of an Ni alloy containing Ni as a predominant component and further containing, as a secondary component, an element selected from among Ru, Zn, V, Co, Nb, Ta and Ti.

In the spark plugs having the first through third structures, respectively, the Ni content of the Ni alloy which constitutes the electrode base material is preferably set to 80% by mass or more in order to increase the coefficient of thermal conductivity of the electrode base material to 17 W/m·K or higher. Further, in order to obtain a remarkable channeling suppressing effect though formation of a corrosion suppression layer (for the first and third structures), or in order to obtain a remarkable effect in improving the thermal transfer property of the electrode (for the second structure), the total content of secondary components of the Ni alloy which constitutes the electrode base material is preferably set to 1.5% by mass or more. Meanwhile, the total content of the secondary components is desirably restricted to not greater than 10% by mass in order to secure sufficiently high consumption resistance of the center electrode.

Next, features which can be commonly added to the spark plugs having the first through third structures, respectively, will be described. First, the center electrode has a structure such a heat-radiation-promoting metal portion made of a material having a coefficient of thermal conductivity higher than that of the electrode base material is embedded within the electrode base material and extends along the axis thereof. By virtue of this configuration, transfer of heat from the tip end portion of the center electrode at which temperature is prone to increase can be promoted effectively, so that the service life of the spark plugs can be increased through suppression of electrode consumption. Here, the side, with respect to the axial direction, on which the tip end surface of the center electrode is located is referred to as the front side, and the side opposite the front side is referred to as the rear side; and the front side of the tip end surface (reference position) of the insulator is considered to be a "+" side and the rear side thereof is considered to be a "−" side. The tip end of the heat-radiation-promoting metal portion is desirably located within a range of ±1.0 mm relative to the tip end surface of the insulator. When the tip end of the heat-radiation-promoting metal portion is retracted into the insulator beyond −1.0 mm relative to the reference position, the effect of promoting, by means of the heat-radiation-promoting metal portion, transfer of heat from the tip end potion of the center electrode becomes insufficient, with the result that the electrode may be consumed quickly. When the tip end of the heat-radiation-promoting metal portion is projected from the tip end surface of the insulator beyond +1.0 mm relative to the reference position, upon progress of consumption of the electrode base material, the heat resistance of the tip end portion of the electrode deteriorates, so that the spark plug may quickly reach the end of its service life.

In the above-described structure, the thickness of the electrode base material as measured along a radial direction with respect to the axis and at an axial position separated rearward by 0.5 mm from the tip end surface of the insulator is preferably set to 30% or more the outer diameter of the center electrode at that position. By virtue of this configuration, while efficiently promoting, by the heat-radiation-promoting metal portion, transfer of heat from the tip end portion of the center electrode at which temperature is prone to increase, it is possible to secure sufficiently high durability against electrode consumption due to sparks in the semi-creeping discharge gap at that position.

Moreover, the ground electrode may have a structure such that its surface portion is formed of an electrode base material made of Ni or an Ni alloy, and a heat-radiation-promoting metal portion made of a material having a coefficient of thermal conductivity higher than that of the electrode base material is embedded within the electrode base material and extends along the longitudinal direction of the electrode. This configuration promotes transfer of heat from the ground electrode to thereby enhance durability against consumption. In this case, in the ground electrode, the tip end of the heat-radiation promoting metal portion material is preferably located within the range of 0.5 to 1.0 mm as measured from the tip end surface of the ground electrode. The heat-radiation-promoting metal portion embedded in the center electrode or the ground electrode is preferably made of Cu or a Cu alloy, which is effective for realizing excellent heat radiation property at low cost.

A portion of the ground electrode and/or the center electrode which forms a spark discharge gap may be a consumption-resistant portion which is made of a noble metal or a composite material predominantly containing the noble metal. This configuration effectively suppress an increase in the spark discharge gap due to electrode consumption, so that the service life of the spark plug can be increased. Preferably, the consumption-resistant portion contains, as a predominant component, at least one noble metal selected from Ir, Pt and Ru. Such a consumption-resistant portion can be formed easily by fixing the consumption-resistant portion to the ground electrode and/or the center electrode through any one of laser-beam welding, electron-beam welding and resistance welding.

Figure 1:
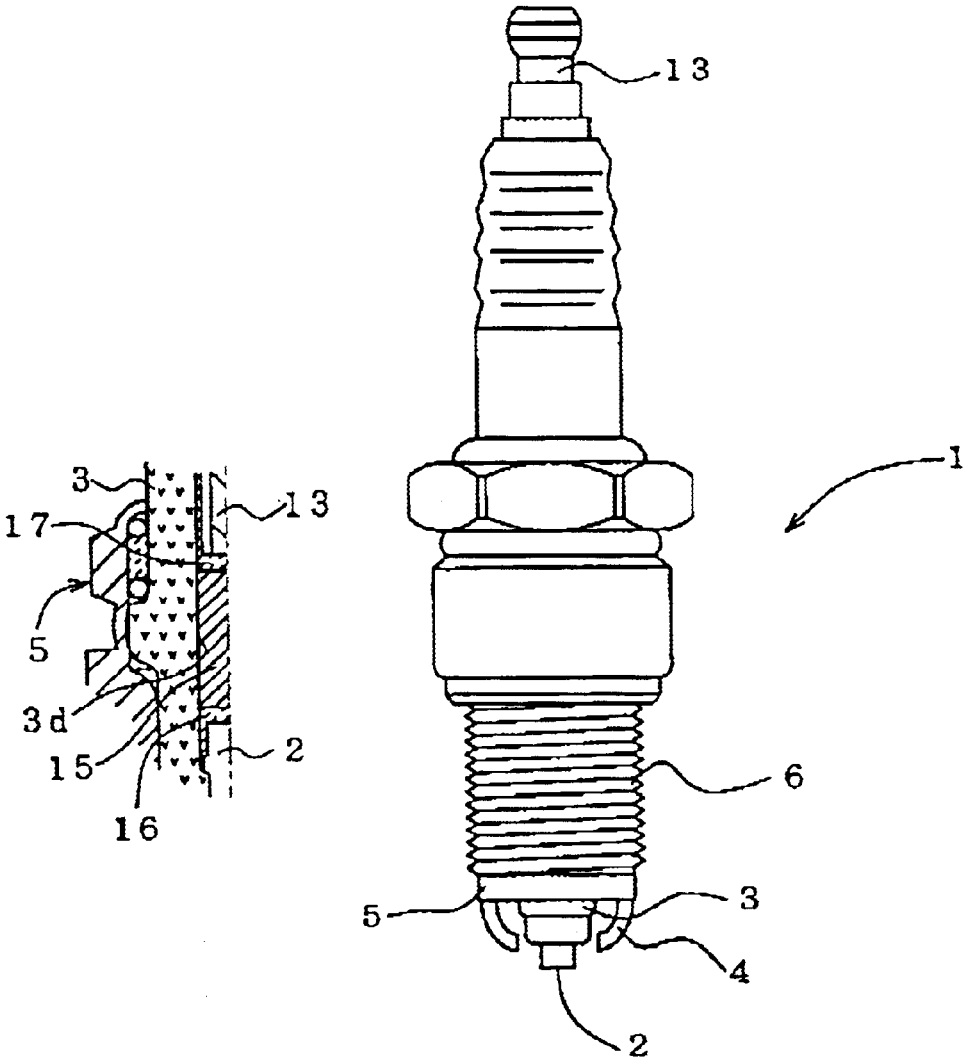
FIG. 1 is an overall view of a spark plug showing one embodiment of the present invention.

Reference numerals are used to identify structural elements shown in the drawings as follows:

1, 100, 200, 300, 400, 450: spark plug

2: center electrode

2*a*: tip end portion

2*b*: outer circumferential surface (discharge surface)

2*c*: base end portion

3: insulator

3*d*: through hole

4, 104: ground electrode

4*a*: end surface (discharge surface)

13: metallic terminal

15: resistor

30, 31: corrosion suppression layer

40–42, 105: consumption-resistant portion

DESCRIPTION OF THE PREFERRED EMBODIMENTS

Several embodiments of the present invention will next be described in detail with reference to the drawings. However, the present invention should not be construed as being limited thereto.

Figure 2:
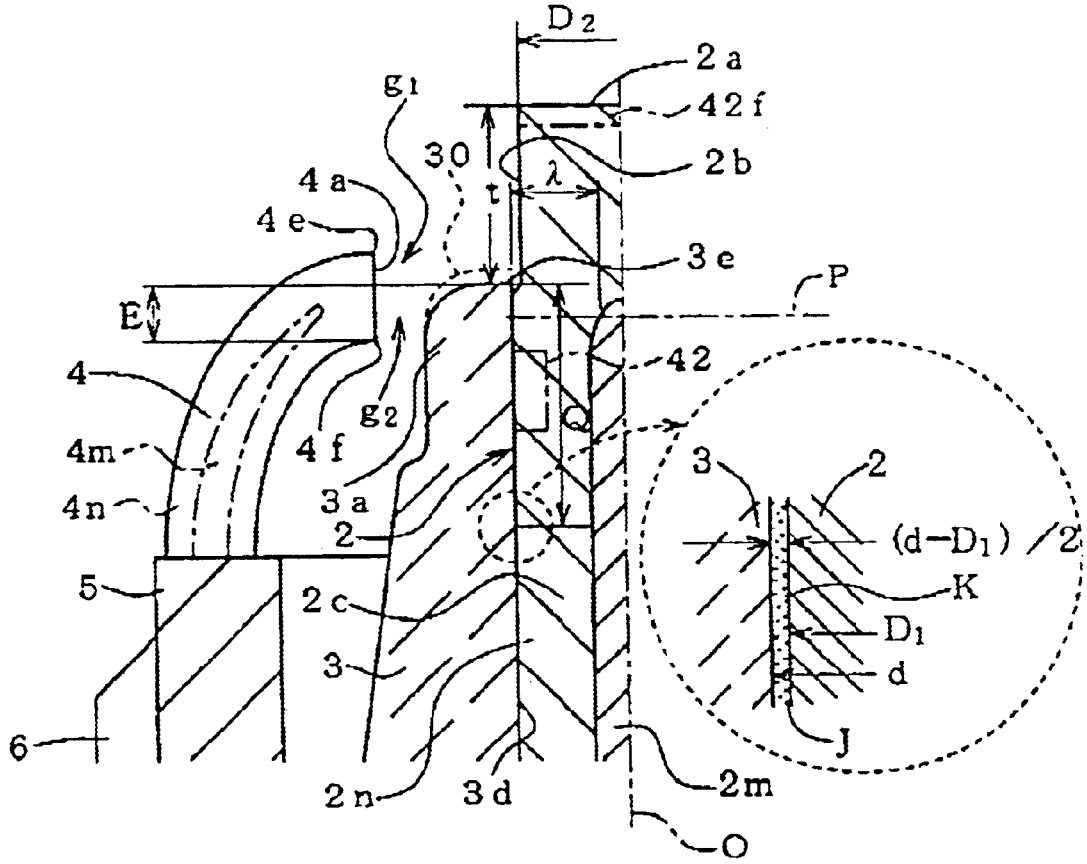
FIG. 2 is an enlarged sectional view showing a main portion of FIG. 1.

A spark plug 1 according to one embodiment of the present invention and shown in FIG. 1 assumes the form of a so-called semi-creeping discharge spark plug. The spark plug 1 includes a cylindrical metallic shell 5; an insulator 3 fitted into the metallic shell 5 such that a tip end portion of the insulator 3 projects from the metallic shell 5; a center electrode 2 disposed within the insulator 3; and two ground electrodes 4 each having a base end connected to the metallic shell 5. The ground electrodes 4 are disposed such that the tip ends (end faces 4*a*) face the side surface of the center electrode 2, while the tip end portion of the insulator 3 is disposed therebetween. The insulator 3 is formed from, for example, a sintered ceramic body, such as alumina or aluminium nitride. As shown in FIG. 2, a through-hole 3*d* is formed in the insulator 3 so as to extend axially through the same. The center electrode 2 is fitted into the through hole 3*d*. The metallic shell 5 is formed from a metal, such as low-carbon steel, and is formed into a cylindrical shape to thereby serve as a housing of the spark plug 1. As shown in FIG. 1, a male-threaded portion 6 is formed on the outer surface of the metallic shell 5 and is adapted to attach the spark plug 1 to an unillustrated cylinder head. As shown in FIG. 2, each of the two ground electrodes 4, one being provided on one side of the center electrode 4 and the other being provided on the other side thereof, is bent such that its end surface (hereinafter may be referred to as a "discharge surface") 4*a* faces the side surface (discharge surface) 2*b* of the tip end portion 2*a* of the center electrode 2 substantially in parallel thereto. The other end of each of the ground electrodes 4 is fixed to and united with the metallic shell 5 by means of, for example, welding.

The insulator 3 is disposed such that the tip end portion 3*a* thereof is disposed between the side surface 2*a* of the center electrode 2 and the discharge surfaces 4*a* of the ground electrodes 4. Here, the side, with respect to the axis O of the center electrode 2, on which the tip end surface of the center electrode 2 is located is referred to as the front side; and the side opposite the front side is referred to as the rear side. In this case, the tip end surface 3*e* of the insulator 3 is located on the front side of the rear-side edge 4*f* of the end surface 4*a* of each ground electrode 4. Meanwhile, the tip end surface of the center electrode 2 projects by a predetermined distance from the tip end surface 3*e* of the insulator 3.

Referring back to FIG. 1, a metallic terminal 13 is fixedly inserted into the through hole 3*d* of the insulator 3 from one end and is fixed therein. Similarly, the center electrode 2 is inserted into the through hole 3*d* from the other end and is fixed therein. A resistor 15 is disposed within the through hole 3*d* and between the metallic terminal 13 and the center electrode 2. The opposite ends of the resistor 15 are electrically connected to the center electrode 2 and the metallic terminal 13 via conductive glass seal layers 16 and 17, respectively. The metallic terminal 13 is formed of, for example, low-carbon steel and its surface is covered with an Ni plating layer (thickness: 5 $\mu$m, for example) for corrosion prevention. The resistor 15 is formed from a resistor composition which is obtained by the steps of mixing glass powder, ceramic powder, metal powder (predominantly containing one or more elements selected from among Zn, Sb, Sn, Ag and Ni), powder of a non-metallic conductive material (e.g., amorphous carbon or graphite), and an organic binder in respective predetermined amounts, and sintering the resultant mixture by a well-known method, such as by use of a hot press.

An electrode base material 2*n*, which forms a surface layer portion of the center electrode 2 (in the present embodiment, a portion other than a heat-radiation-promoting metal portion 2*m* which is formed of Cu or a Cu alloy and inserted into the center of the electrode in order to improve heat transfer) is formed of a metal alloy which contains Ni as a predominant component and Cr and which has a coefficient of thermal conductivity of 17 to 30 W/m·K. The metal alloy which constitutes the base electrode metal 2*n* may be an Ni-base alloy containing Ni in an amount of 80% by mass (weight) or more and Cr in an amount of 1.5 to 9% by mass (preferably, 2 to 5% by mass), or an Ni-base alloy containing Ni in an amount of 80% by mass or more, Cr in an amount of 1.5 to 9% by mass (preferably, 2 to 5% by mass), and Fe in an amount of 1 to 5% by mass, where the total amount of Fe and Cr is 2 to 9% by mass. Meanwhile, the ground electrodes 4 may be formed of the same material as that of the center electrode 2. However, the material of the ground electrodes 4 is not limited thereto, and the ground electrodes 4 may be formed of an Ni-base alloy having a composition falling outside the above-described range, insofar as the Ni-base alloy contains a predominant amount of Ni.

Next, operation of the spark plug 1 will be described.

The spark plug 1 is mounted to an internal combustion engine, such as a gasoline engine, via the male-threaded portion 6 thereof (FIG. 1) and used to ignite air-fuel mixture supplied to a combustion chamber. High voltage for discharge is applied to the spark plug 1 such that the center electrode 2 assumes a negative polarity and the ground electrodes 4 assume a positive polarity. Thus, in FIG. 2, a spark is generated due to discharge between the discharge surface 4*a* of each ground electrode 4 and the side surface (discharge surface) 2*b* of the tip end portion 2*a* of the center electrode 2, and the mixture is ignited by means of the spark. Notably, the spark plug functions as a semi-creeping discharge-type spark plug in which a spark propagates through a path along the surface of the tip end portion of the insulator 3. Among the plurality of the ground electrodes 4 disposed around the center electrode 2, at least one (all in the present embodiment) of the ground electrodes 4 is disposed such that its end surface faces the side surface of the center electrode 2, with the tip end portion of the insulator 3 being located therebetween (i.e., the ground electrode 4 serves as a semi-creeping ground electrode which forms a semi-creeping discharge gap in cooperation with the side surface of the center electrode 2).

As shown in FIG. 2, in the spark plug 1 of the present embodiment, the tip end portion 2*a* of the center electrode 2 projects from the tip end surface 3*e* of the insulator 3. Therefore, a first gap g1 is formed between the side surface 2*b* and the discharge surface 4*a* of each ground electrode 4, and a second gap g2 is formed between the outer circumferential surface of the insulator 3 and the discharge surface 4*a*.

In the spark plug 1 of the present embodiment, the electrode base material, which constitutes at least the discharge surfaces (2*b* and 4*a*) of the center electrode 2 and the ground electrodes 4, contains at least one element selected from among Fe, Cr and Cu as an insulator corrosion suppressing component. When such a spark plug is attached to an internal combustion engine, which is operated at high speed above a predetermined level or under heavy load above a predetermined level, as shown in FIG. 2, a corrosion suppression layer 30 derived form the constituent components (specifically, including Cr and Fe) of the electrode base material 2*n* of the center electrode 2 is formed on the surface of the tip end portion of the insulator 3 during spark discharge. As a result, even when creeping discharge occurs and thus a spark travels across the second gap g2, the surface of the insulator 3 is protected by the corrosion suppression layer 30, so that progress of channeling is prevented or suppressed effectively.

The corrosion suppression layer 30 formed as a result of spark discharge may be an oxide-base compound which contains Fe, Cr, or Cu as a cationic component; specifically, the above-described NTC oxide semiconductor (e.g., $Fe_2O_3$ and $Cr_2O_3$). In this case, the effect of preventing channeling becomes more remarkable. The corrosion suppression layer 30 mainly formed of an oxide-base compound containing any one of the above-described elements is likely to exhibit electrical semi-conductivity, and is expected to improve the channeling-prevention performance due to its current dispersion effect. When the discharge voltage at the spark discharge gap drops, capacitive discharge current during spark discharge decreases, so that attack by sparks is weakened, expectedly contributing to suppression of electrode consumption and mitigation of channeling.

The present inventors consider that the above-described corrosion suppression layer 30 is formed through the following mechanism. That is, upon generation of spark discharge S, gas molecules in the vicinity of the spark discharge gaps g1 and g2 are ionized; and the thus-produced ions impinge the discharge surface due to a gradient of electrical field created between the electrodes 2 and 4, so that the metal components of the electrodes are forced out of the discharge surfaces. In general, combustion gas creates a high-temperature, oxidizing atmosphere within the combustion chamber in which the spark discharge gaps g1 and g2 are disposed. Therefore, the metal components forced out of the discharge surfaces are immediately converted to oxides, which are deposited on the surface of the insulator 3, to thereby form the corrosion suppression layer 30. This mechanism is similar to that of a reactive sputtering process in which the metallic material, which constitutes the discharge surfaces, is used as a target. In the present embodiment, since the center electrode 2 assumes a negative polarity, during generation of cationic ions, the discharge surface of the center electrode 2 mainly serves as a source of components of the corrosion suppression layer 30. However, during high-speed or heavy-load operation, during which the electrodes 2, 4 have high temperatures, the metallic material of the discharge surfaces may be partially melted and scattered, and may be oxidized and deposited on the surface of the insulator. In such a case, the discharge surfaces 4*a* of the ground electrodes 4 can serve as a source of components of the corrosion suppression layer 30. Notably, in some cases, a portion of the metal elements forced out of the discharge surfaces may be incorporated into the corrosion suppression layer 30 without being oxidized; i.e., in the form of metal elements. This decreases the electrical resistivity of the corrosion suppression layer 30, which may be advantageous in obtaining the channeling prevention effect by current dispersion.

Whether or not the above-described corrosion suppression layer 30 is formed to a considerable extent depends on conditions of use of the spark plug; specifically, the temperatures of the discharge surfaces 4*a* and 2*b* (e.g., the temperature at the tip end portion 2*a* of the center electrode 2 or the vicinity thereof) and other factors. Therefore, under operating conditions under which the temperatures of the discharge surfaces 4*a* and 2*b* are prone to increase, such as during high-speed or heavy-load operation, the discharge surface 2*b* is likely to undergo evaporation as in the case of sputtering, thereby promoting formation of the corrosion suppression layer 30. With progressive establishment of conditions under which channeling is prone to occur, the formation of the corrosion suppression layer 30, which prevents or suppresses the channeling, proceeds. As a result, an excellent channeling prevention effect can be attained. Although the conditions regarding the temperature of the discharge surface which must be satisfied in order to promote the formation of the corrosion suppression layer 30 are affected by, for example, the composition of combustion gas, and air-fuel ratio, in general, conceivably, temperatures equal to or higher than 500° C. promote the formation of the corrosion suppression layer 30.

As shown in FIG. 2, the difference ($d-D_1$) between the outer diameter $D_1$ of the center electrode 2 and the diameter d of the through hole 3*d*, into which the center electrode 2 is inserted, is preferably 0.07 mm or more as measured at a position separated from the tip end of the insulator 3 by a distance Q of 5 mm as measured along the axial direction. When the tip end portion 2*a* of the center electrode 2 is reduced in diameter to have a diameter smaller than that of the base end portion 2*c*, the difference ($d-D_1$) between the outer diameter $D_1$ of the base end portion 2*c* of the center electrode 2 and the diameter d of the through hole 3*d* is set to 0.07 mm or more.

All of the reaction product formed through oxidation of evaporated metal components of the electrodes does not necessarily contribute to formation of the corrosion suppression layer; a portion of the reaction product accumulates in the clearance K between the center electrode 2 and the through hole 3*d* as dust. Meanwhile, in some cases, the formed corrosion suppression layer 30 is partially removed by sparks produced by creeping discharge, and similar dust J is produced. When the clearance is small, generated dust J accumulates in the clearance K and fills the clearance K densely. In such a case, upon repetition of heating/cooling cycles, the insulator 3 may crack due to difference in thermal expansion between the center electrode 2 and the insulator 3. However, when the difference $d-D_1$ is set to 0.07 mm or more, the dust J is prevented from densely filling the clearance K, so that the insulator 3 hardly cracks even when heating/cooling cycles are repeated. However, when the difference $d-D_1$ exceeds 0.3 mm, heat resistance is lowered, and the center electrode 2 tends to be assembled in an eccentric state. Therefore, the difference $d-D_1$ is preferably set to 0.3 mm or less, more preferably 0.07 to 0.15 mm.

When voltage is applied to the spark plug 1 such that the center electrode 2 assumes a positive polarity, only a small amount of dust is generated, and therefore, the difference $d-D_1$ can be narrowed to, for example, 0.03 mm or more (preferably, 0.04 mm or more).

An effective measure for enhancing the channeling resisting property of the spark plug is establishment of an operation environment in which attack of creeping discharge sparks against the insulator 3 does not become excessive. For example, such an environment can be established effectively through avoiding instantaneous application of excessive discharge voltage to the electrodes, or suppressing the tendency of discharge concentrating at a single position and dispensing the discharge. One example of the former is adjusting the electrical resistance of the resistor 15 (shown in FIG. 1) such that the resistor 15 has an electrical resistance of 2 kΩ or greater (preferably, 5 kΩ or greater) as measured between the metallic terminal 13 and the center electrode 2. The electrical resistance of the resistor 15 can be adjusted by changing the composition or dimension of the resistor 15.

Meanwhile, one example of the latter is provision of two or more ground electrodes 4. In particular, when the number of the ground electrodes 4 is increased to 3 or more, the channeling resistance can be improved remarkably.

In FIG. 2, the diameter of the tip end portion 2*a* of the center electrode 2 is denoted by D2. This diameter D2 is advantageously increased in order to provide divided discharge passages. Specifically, the diameter D2 is desirably set to 2.0 mm or more. Meanwhile, the smaller the diameter D2 of the tip end portion 2*a* of the center electrode 2, the smaller the volume of the tip end portion 2*a* of the center electrode 2 and the smaller the amount of heat of flames produced upon ignition that is absorbed by the center electrode 2, with a resultant increase in the ignition performance of the spark plug. Further, since the tip end portion 2*a* of the center electrode 2 or the tip end portion of the insulator 3 to be cleaned by means of generated sparks decreases in surface area, the contamination resistance of the spark plug can be improved. In consideration of the balance therebetween, the diameter D2 of the tip end portion 2*a* of the center electrode 2 is adjusted within the range of 0.6 to 2.2 mm. When the diameter D2 is less than 0.6 mm, the channeling suppression effect may become insufficient. When the diameter D2 is in excess of than 2.2 mm, sufficient contamination resistance cannot be secured.

The spark plug 1 is configured such that the tip end surface 3*e* of the insulator 3 is located on the front side of the rear-side edge 4*f* of the end surface (discharge surface) 4*a* of each ground electrode 4. This configuration further improves the channeling resistance of the spark plug. A conceivable reason for this is as follows. In FIG. 2, a discharge passage ending at the rear-side edge 4*f* of the end surface of each ground electrode 4 is blocked by the insulator 3, and conceivably, discharge is prone to occur at the front-side edge 4*e* at which aerial discharge mainly occurs.

In FIG. 2, reference character E denotes the distance between the tip end surface 3*e* of the insulator 3 and the end surface 4*a* of each ground electrode 4 as measured along the axis O of the center electrode 2 (i.e., the distance of overlap between the tip end surface of each ground electrode (semi-creeping electrode) 4 and the side surface of the tip end portion of the center electrode 2 along the axis O of the center electrode 2). The distance E is preferably set to 0.2 mm or more. Meanwhile, when the distance E is set to 1.2 mm or less, sparks do not strongly attack the surface of the insulator 3 even when the rear-side edge of the end surface of the ground electrode serves as the end of the discharge passage, so that the channeling resistance of the spark plug can be improved.

Here, the side, with respect to the axis O, on which the tip end surface 2*a* of the center electrode 2 is located is referred to as the front side, and the side opposite the front side is referred to as the rear side; and the front side of the tip end surface 3*e* (reference position) of the insulator 3 is considered to be a "+" side and the rear side thereof is considered to be a "−" side. The tip end of the heat-radiation-promoting metal portion 2*m* is desirably located within a range of ±1.0 mm relative to the tip end surface of the insulator.

As shown in FIG. 2, the center electrode 2 has a structure such that the heat-radiation-promoting metal portion 2*m* made of a material having a coefficient of thermal conductivity higher than that of the electrode base material 2*n* is embedded within the electrode base material 2*n* and extends along the axis O. In this case, the thickness X of the electrode base material 2*n* as measured along a radial direction with respect to the axis O and at a position P along the axis O, which is separated rearward by 0.5 mm from the tip end surface 3*e* of the insulator 3, is preferably set to 30% or more the outer diameter of the center electrode 2 measured at the position P (e.g., 0.6 mm or more when the outer diameter of the center electrode 2 measured at the position P is about 2 mm). This configuration provides sufficiently high durability against electrode consumption due to sparks at that position in the semi-creeping discharge gap, while promoting transfer of heat, by way of the heat-radiation promoting metal portion 2*m*, from the tip end portion of the center electrode 2 where temperature is prone to increase easily. Although increasing the outer diameter of the heat-radiation-promoting metal portion 2*m* to a possible extent is effective for promoting the heat transfer, when the heat-radiation-promoting metal portion 2*m* is thickened over the entire length thereof, in some cases, the thickness X of the electrode base material 2*n* at the position P cannot be set to 30% or more the outer diameter of the center electrode 2. Therefore, decreasing the diameter of the tip end portion of the heat-radiation-promoting metal portion 2*m* is effective for rendering the thickness X within the above-described range.

As indicated by an alternate long and short dash line in FIG. 2, each ground electrode 4 may have a structure such that its surface portion is formed of an electrode base material 4*n* made of Ni or an Ni alloy, and a heat-radiation promoting metal portion 4*m* made of a material having a coefficient of thermal conductivity higher than that of the electrode base material 4*n* is embedded within the electrode base material 4*n* and extends along the longitudinal direction of the electrode. This configuration promotes transfer of heat from the ground electrode 4 to thereby enhance durability against consumption. In this case, in the ground electrode 4, the tip end of the heat-radiation promoting metal portion 4*m* is preferably located within the range of 0.5 to 1.0 mm as measured from the tip end surface of the ground electrode 4. When the distance between the tip end of the heat-radiation promoting metal portion 4*m* and the tip end surface of the ground electrode 4 is greater than 1.0 mm, the effect of promoting transfer of heat, by way of the heat-radiation-promoting metal portion 4*m*, from the tip end portion of the ground electrode 4 becomes insufficient. When the distance between the tip end of the heat-radiation promoting metal portion 4*m* and the tip end surface of the ground electrode 4 is less than 0.5 mm, the heat resistance of the tip end portion of the electrode decreases when the consumption of the electrode base material 4*n* proceeds, whereby the spark plug 1 quickly reaches the end of its service life.

The above-described heat-radiation-promoting metal portions 2*m* and 4*m* can be made of Cu, Ag, or an alloy containing Cu or Ag as a predominant component. In particular, although Cu and Cu alloys have coefficients of thermal conductivity slightly lower than that of Ag, Cu and Cu alloys are considerably inexpensive as compared with Ag, and have relatively high heat resistance and excellent machinability. Therefore, use of Cu and Cu alloys is preferable in the present invention.

Figure 3:
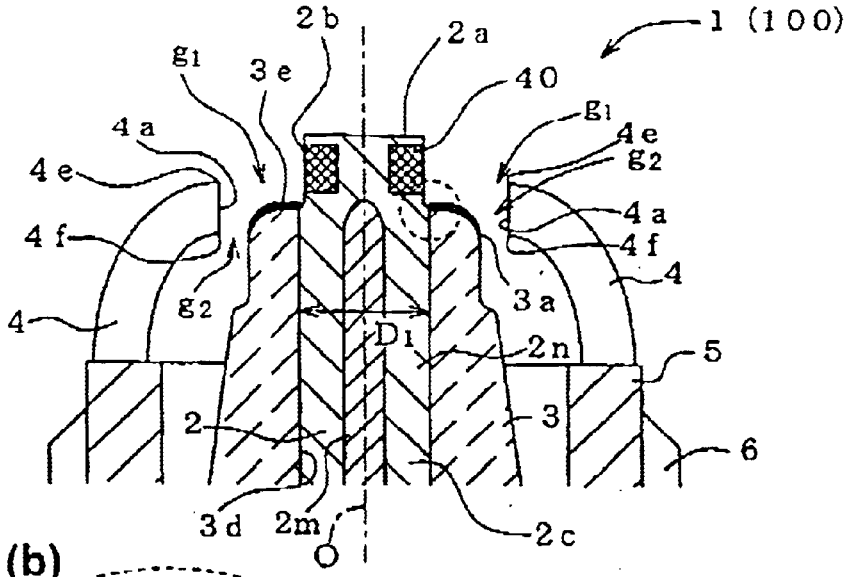
FIG. 3(*a*) is a main-portion longitudinal sectional view showing an example in which a corrosion suppression layer is formed in advance on the surface of the insulator, and FIGS. 3(*b*) and 3(*c*) are expanded views.
Figure 3:
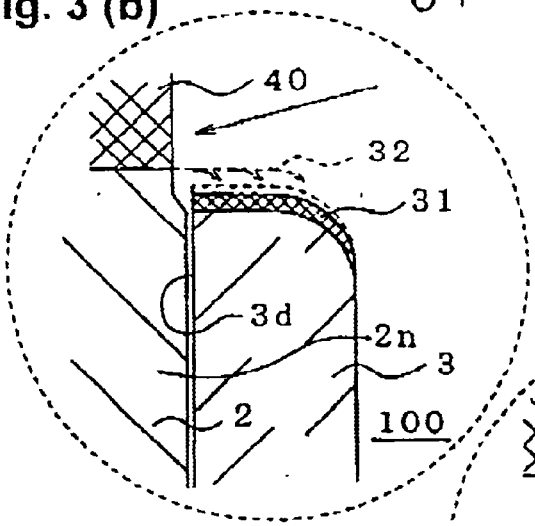
Figure 3:
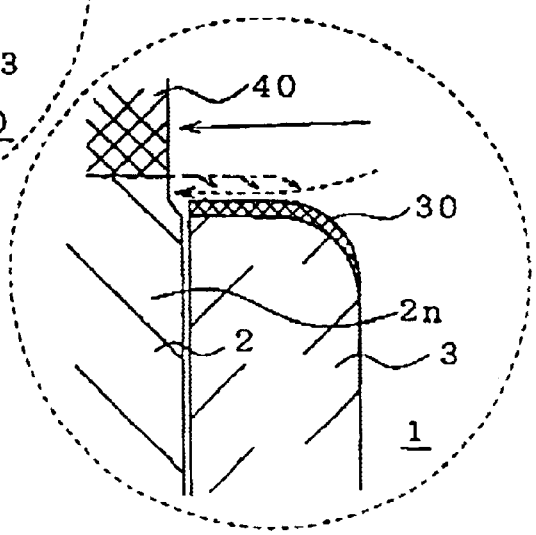

As shown in FIG. 3(*a*), in the spark plug 1, portions of the ground electrodes 4 and/or the center electrode 2, including portions of the discharge surface 4*a* and/or the discharge surface 2*a*, may be consumption-resistant portions which are made of a noble metal or a composite material predominantly containing the noble metal. This suppress an increase in the spark discharge gap due to electrode consumption, so that high ignition performance can be maintained over a long period of time even when the spark plug is used under severe conditions. Particularly preferably, the consumption-resistant portions contain, as a predominant component, at least one element selected from Ir, Pt and Ru. In the spark plug 1 shown in FIG. 3, an annular consumption-resistant portion 40 is formed in the tip end portion 2*a* of the center electrode 2 to be located at the center of the outer circumferential surface (discharge surface) 2*b* with respect to the axial direction thereof. The consumption-resistant portion 40 is made of a Pt—Ni alloy; e.g., an alloy containing Pt in a predominant amount and Ni in an amount 6% by mass or more.

The consumption-resistant portion 40 is bonded to the ground electrode 4 and/or center electrode 2 by means of laser-beam welding, electron-beam welding, or resistance welding. Specifically, a chip made of the above-described noble metal or composite material is fixedly welded to the ground electrode 4 and/or center electrode 2 in order to form the consumption-resistant portion 40. Since the above-described material which forms the consumption-resistant portion 40 has excellent heat resistance and corrosion resistance, consumption of the consumption-resistant portion 40 can be suppressed, and thus the durability of the spark plug 1 can be improved. Further, a phenomenon (called "sweating" in some cases) of a material melted due to discharge being scattered and deposited on the discharge surfaces hardly occurs, and a phenomenon (called "bridging") of a short circuit being formed at the spark discharge gap due to such deposit hardly occurs. The consumption-resistant portion 40 may be formed to include an edge portion of the tip end surface of the center electrode 2.

The consumption-resistant portion 40 can be formed as follows, for example. That is, a groove (e.g., a groove having a trapezoidal cross section) is formed along a circumferential direction at the tip end portion of an electrode material of Ni, which is to serve as the center electrode 2; and an annular Pt member (e.g., a Pt wire rounded into an annular shape) is fitted into the groove and caulked. Subsequently, while the electrode material is rotated at a predetermined speed, a laser beam is radiated onto the Pt member. Thus, the Pt member and the electrode material are melted, so that a Pt—Ni alloy portion (i.e., the consumption-resistant portion 40) is formed. The radiation conditions of the laser beam and the dimensions of the Pt member are adjusted such that the Ni content of the Pt—Ni alloy portion becomes 15% by mass or more. When the consumption-resistant portion 40 is formed to include an edge portion of the tip end surface of the center electrode 2, the tip end portion of the electrode material is removed though slicing, polishing, or cutting such that a discharge surface formed by the Pt—Ni alloy portion is exposed at the circumferential edge of the tip end surface.

When, as shown in FIG. 3(*a*), the consumption-resistant portion 40 is formed on the outer circumferential surface of the center electrode 2, the consumption-resistant portion 40 is preferably formed so as not to cross regions located on opposite sides of the tip end of the insulator 3 with respect to the axis O of the center electrode 2; i.e., in such a manner that a metallic material surface (including Fe and Cr serving as corrosion-suppressing-layer-forming components) of the electrode base material 2*n* of the center electrode 2 faces the tip end surface 3*e* of the insulator 3. By virtue of this configuration, when a creeping discharge spark is generated as shown in FIG. 3(*c*), the spark hits the metallic material surface to thereby promote supply of corrosion-suppressing-layer-forming components and formation of a corrosion suppression layer 30. As a result, the channeling prevention effect is enhanced.

Figure 9:
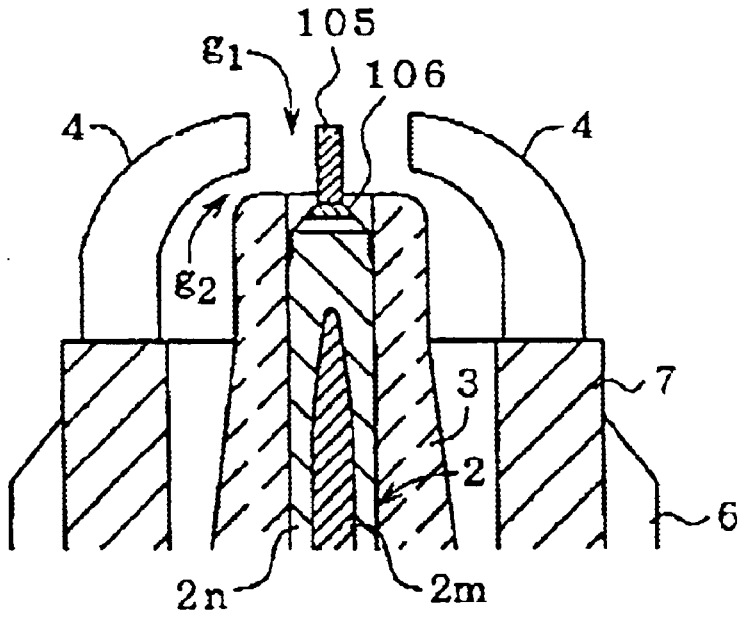
FIGS. 9(*a*) and 9(*b*) are sectional views of a spark plug in which a consumption-resistant portion of a noble metal is formed at the tip end portion of the center electrode, each showing an example in which at least a portion of an all-round laser welding portion for joining the consumption-resistant portion is positioned inside the insulator.
Figure 9:
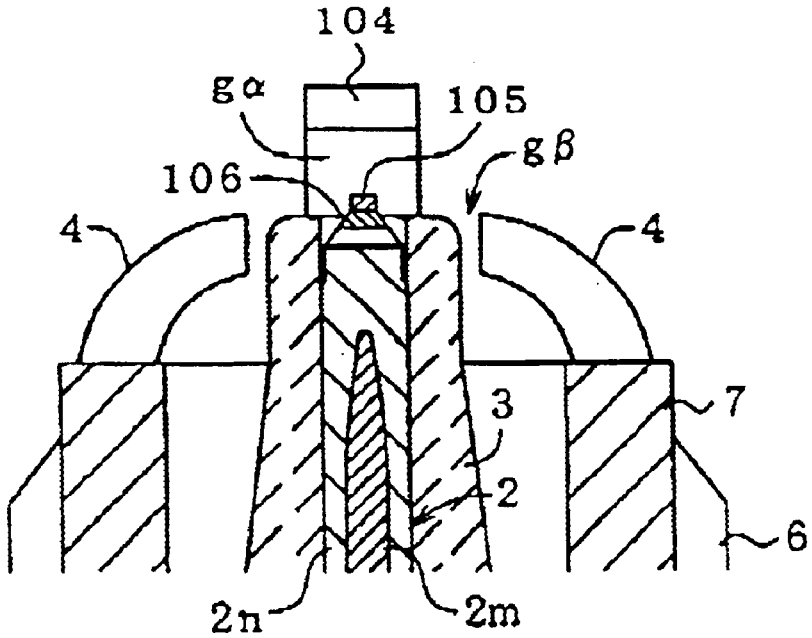

The spark plug 1 may be configured as shown in FIG. 9(*a*). A circular columnar noble-metal chip is placed on the tip end surface of the center electrode 2; and an all-round laser welding portion 106 is formed along an overlapping surface thereof to extend between the electrode base material 2*n* and the noble-metal chip. In this case, the noble-metal chip serves as a consumption-resistant portion 105. The all-round laser welding portion 106 may be formed such that at least a portion of the all-round laser welding portion 106 is retracted inward from the tip end surface 3*e* of the insulator 3 with respect to the axial direction thereof.

In the spark plug 1 shown in FIG. 2, at least a portion of the end surface 4*a* of the tip end portion of the ground electrode 4 may be formed to serve as a consumption-resistant portion. As in the case of the above-described consumption-resistant portion 40, a Pt—Ni alloy; e.g., an alloy containing Pt in a predominant amount and Ni in an amount of 15% by mass or more, may be used to form the consumption-resistant portion. Since the above-described material which forms the consumption-resistant portion has excellent heat resistance and corrosion resistance, consumption of the end surfaces 4*a* of the tip end portions of the ground electrodes 4 can be suppressed, and thus the durability of the spark plug 1 can be improved. The consumption-resistant portion can be formed by fixing a chip made of the above-described noble metal or composite material to the end surface by means of laser welding or resistance welding. For example, a depression is formed in the end surface 4*a*; a chip is fitted into the depression; and a welding portion is formed at the boundary portion, to thereby provide a consumption-resistant portion.

Although both the consumption-resistant portion 40 of the center electrode 2 (FIG. 3(*a*)) and the consumption-resistant portion of the ground electrode 4 may be formed, in the case in which the ground electrode 4 is not consumed to a problematic level, it may be the case that only the consumption-resistant portion 40 of the center electrode 2 is provided without provision of the consumption-resistant portion of the ground electrode 4. Notably, voltage of the opposite polarity may be applied to the above-described spark plug 1 such that the center electrode 2 becomes positive.

In the above-described spark plug 1, as shown in FIG. 2, the corrosion suppression layer 30 originating from the metallic material which constitutes the discharge surface 2*b* or 4*a* is formed on the surface of the insulator 3. However, a spark plug 100 shown in FIG. 3(*b*) in which a corrosion suppression layer 31 is formed on the surface of the insulator 3 in advance achieves substantially the same effects as those achieved by the above-described spark plug 1. In this case, the corrosion suppression layer 31 can be made of an oxide-base semiconductor compound which contains at least one element selected from among Fe, Cr, Cu and Sn as a cationic component. The corrosion suppression layer 31 made of such an oxide-base semiconductor compound which contains at least one of the aforementioned elements can be formed by means of any of various vapor-phase film forming methods such as radio frequency sputtering, reactive sputtering, or ion plating. Alternatively, the corrosion suppression layer 31 may be formed by use of a sol-gel method in which an oxide sol is prepared through, for example, hydrolysis of a metalalkoxide and is then applied to the insulator 3, followed by drying, to thereby obtain an oxide coating film.

In this case, although no particular limitation is imposed on the materials of the center electrode 2 and/or the ground electrode 4, the center electrode 2 and/or the ground electrode 4 may be formed of a metallic material which contains, as an insulator corrosion suppressing component, at least one element selected from among Fe, Cr and Cu, as in the above-described case. During spark discharge, a reaction product 32 containing Cr or Fe originating from the electrode base material component of the center electrode 2 is deposited on the corrosion suppression layer 31, which has already been formed on the surface of the tip end portion of the insulator 3. Thus, loss of the corrosion suppression layer 31 due to creeping discharge is compensated, so that the channeling prevention effect continues over a prolonged period of time.

Figure 4:
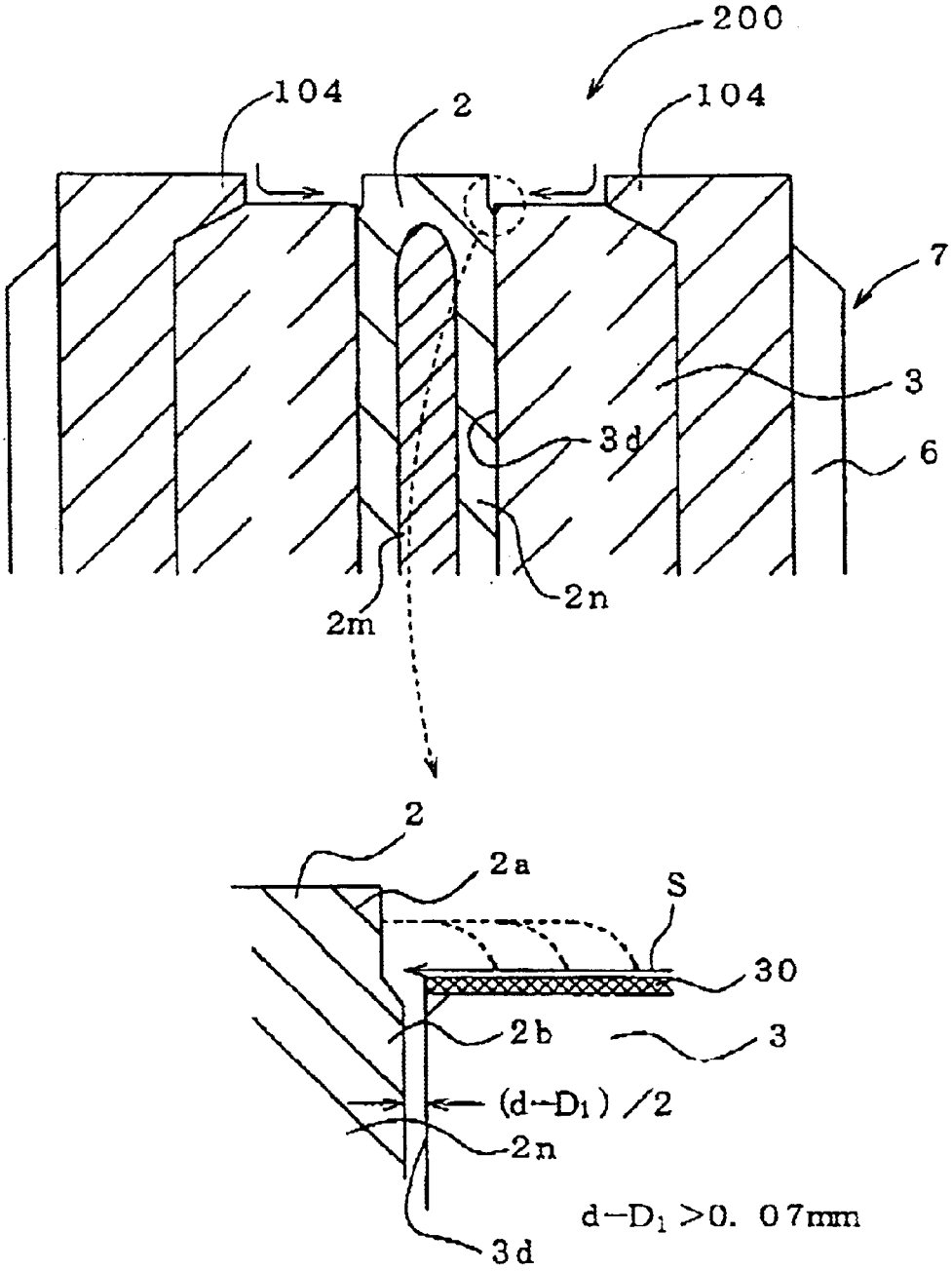
FIG. 4 is a main-portion longitudinal sectional view showing an example in which the present invention is applied to a full creeping discharge spark plug.

Although the embodiment of the present invention has been described while a semi-creeping discharge spark plug is taken as an example, the present invention is not limited thereto. Other embodiments will described below (the same structural elements as those of the spark plug 1 will be denoted by the same reference numerals, and repeated description will be omitted). For example, FIG. 4 shows a full-creeping discharge spark plug 200 in which inner surfaces of ground electrodes 104 are brought into contact with the surface of the insulator 3, so that creeping discharge spark S is produced over the entire distance between the ground electrodes 104 and the center electrode 2.

Figure 5:
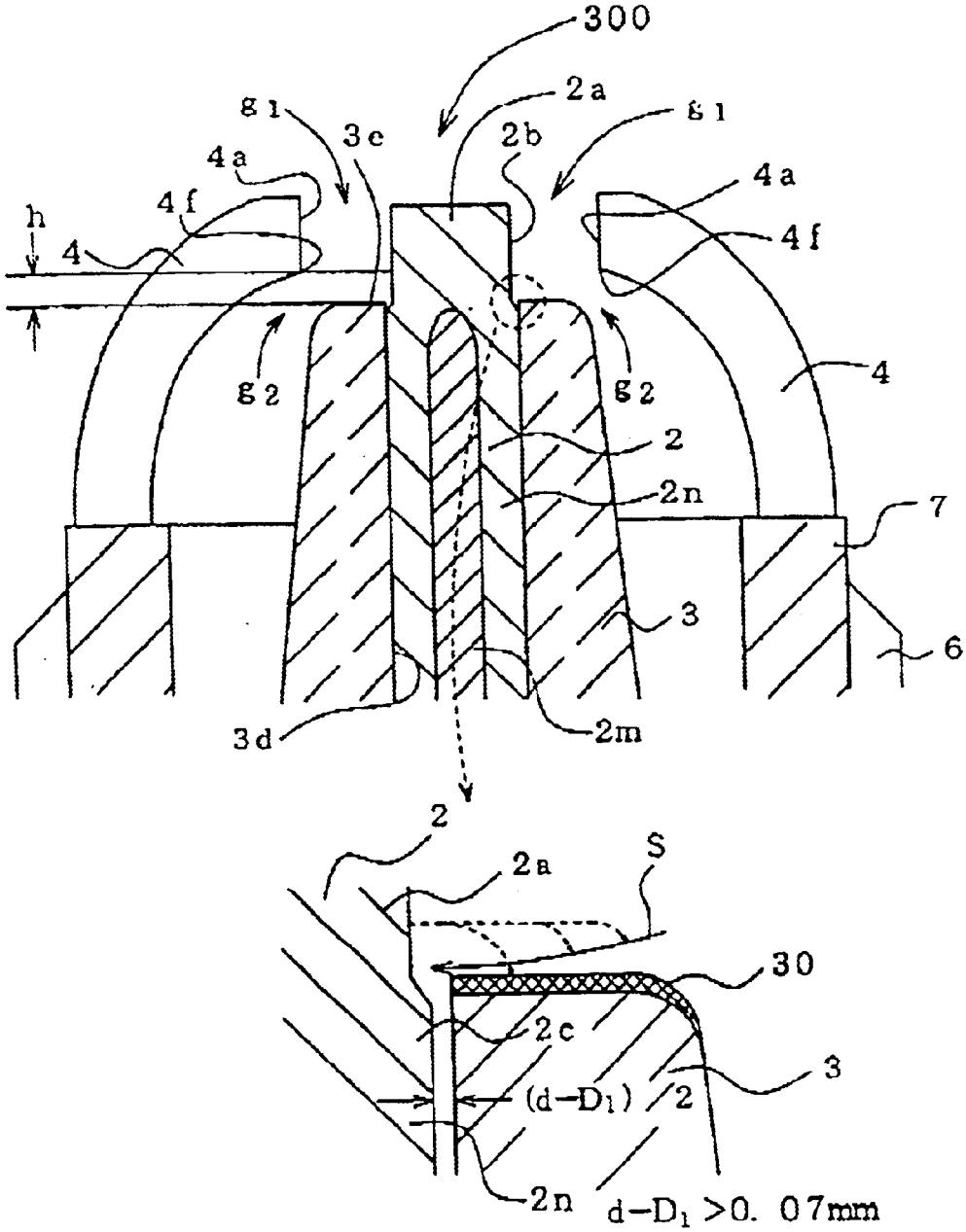
FIG. 5 is a main-portion longitudinal sectional view showing an example in which the present invention is applied to an intermittent creeping discharge spark plug.

In a spark plug 300 of FIG. 5, the tip end portion of the insulator 3 does not enter the space (a first gap g1) between the side surface 2*b* of the tip end portion 2*a* of the center electrode 2 and the tip end surface 4*a* of each ground electrode 4. The distance (a second gap g2) between the tip end surface 3*e* of the insulator 3 and the rear-side edge 4*f* of the tip end surface 4*a* of the ground electrode 4 is rendered smaller than the distance between the outer circumferential surface 2*b* of the tip end portion 2*a* of the center electrode 2 and the tip end surface 4*a* of the ground electrode 4. That is, the center electrode 2 is disposed in the insulator 3 such that the tip end portion 2*a* of the center electrode 2 projects from the insulator 3; and a cylindrical metallic shell 7 is provided to surround the insulator 3. The base end of each ground electrode 4 is welded to an end portion of the metallic shell 7; and the tip end portion of each of the ground electrodes 4 is bent toward the center electrode 2 such that the tip end surface 4*a* of the ground electrode 4 faces the side surface 2*b* of the projecting tip end portion 2*a* of the center electrode 2 to thereby form the first gap g1, and the inner surface of the tip end portion of the ground electrode 4 faces the tip end surface 3*e* of the insulator 3 to thereby form the second gap g2, which is smaller than the first gap g1. The spark plug 300 is of a so-called intermittent creeping discharge type which is designed such that spark discharge S occurs at the second gap g2 on which contamination of the insulator 3 proceeds.

Figure 6:
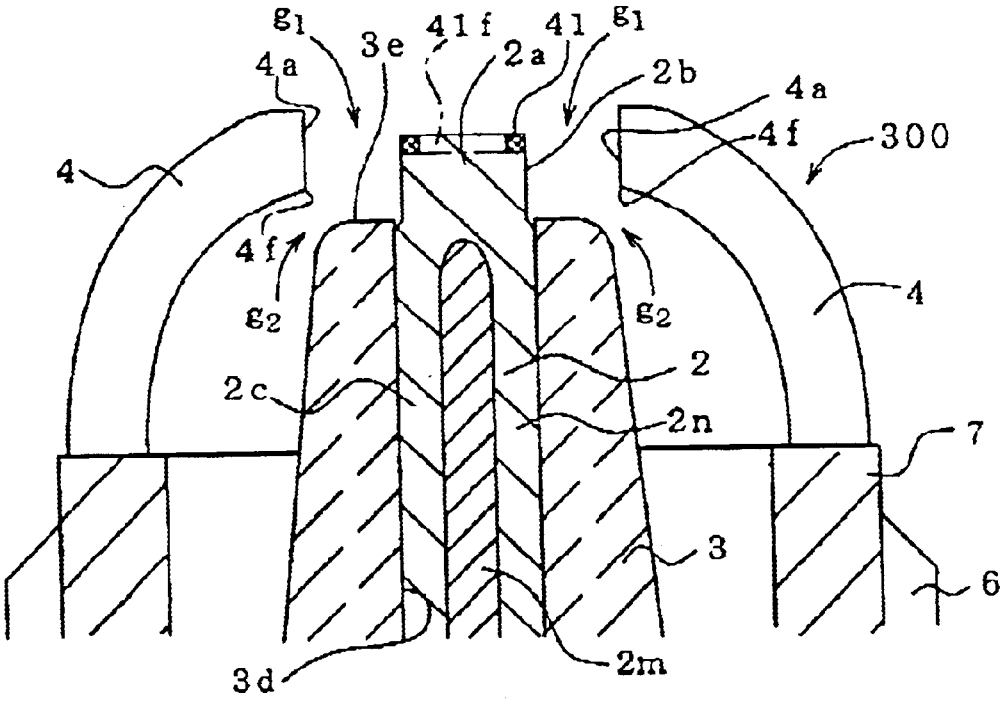
FIGS. 6(*a*) and 6(*b*) are main-portion longitudinal sectional views each showing an example in which a consumption-resistant portion is formed on the outer circumferential surface of the center electrode of the spark plug of FIG. 5.
Figure 6:
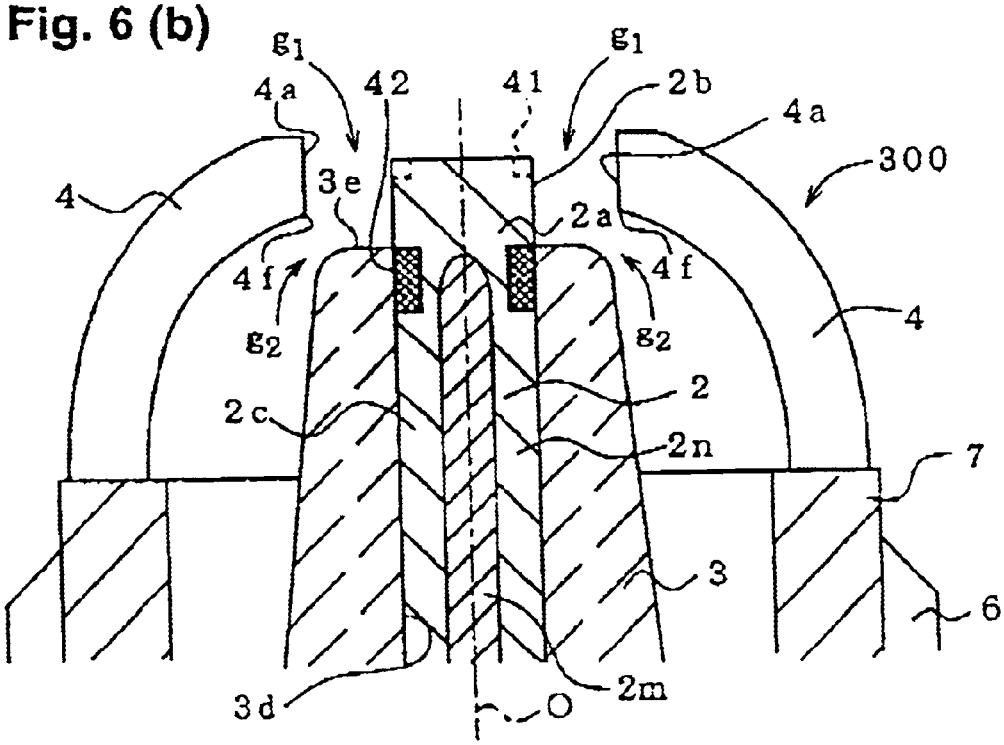

In this case as well, as shown in FIGS. 6(*a*) and 6(*b*), a consumption-resistant portion 41 or 42, which is similar to the above-described consumption-resistant portion 40, may be provided on the center electrode 2. In the example of FIG. 6(*a*), the consumption-resistant portion 41 is formed to include the edge of the tip end surface of the center electrode 2. In place of the consumption-resistant portion 41, a disc-shaped chip may be fixed to the tip end surface of the center electrode 2 in order to form a consumption-resistant portion 41*f* as indicated by an alternate long and short dash line in FIG. 6(*a*). The chip may be fixed to the tip end surface by means of laser welding or electron-beam welding performed along the outer circumferential edge of the joint surface. Further, when the predominant metal of the chip is Pt or Ru, resistance welding may be employed.

In the example of FIG. 6(*b*), the consumption-resistant portion 42 is accommodated in the through hole 3*d* of the insulator 3 (that is, the consumption-resistant portion 42 does not cross regions located on opposite sides of the tip end of the insulator 3 with respect to the axis O of the center electrode 2). In addition to the consumption-resistant portion 42, the consumption-resistant portion 41 (as indicated by an alternate long and short dash line in FIG. 6(*b*)) or the consumption-resistant portion 42*f* (as indicated by an alternate long and short dash line in FIG. 2) may be formed in the semi-creeping discharge spark plug 1 in the same manner.

Figure 7:
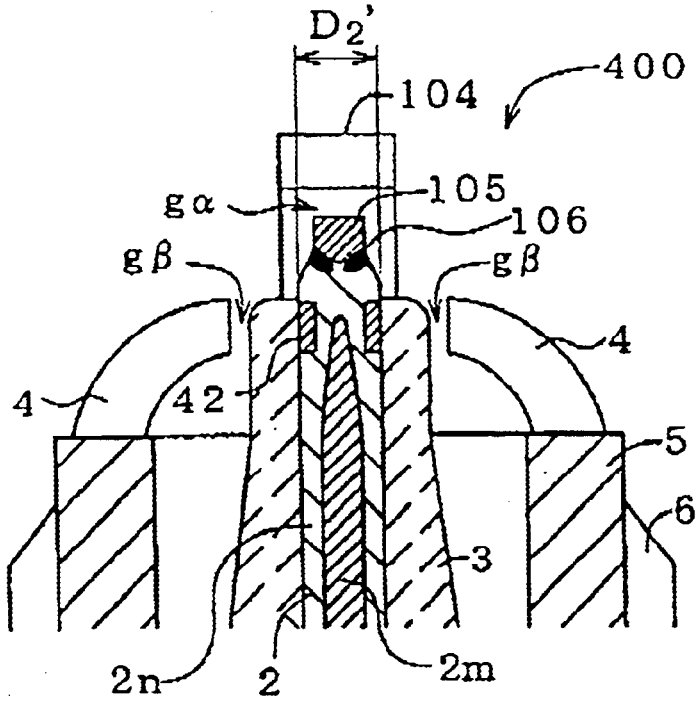
FIG. 7(*a*) is a main-portion front sectional view and FIG. 7(*b*) is a main-portion side sectional view showing an example of a spark plug which has a ground electrode facing the tip end surface of the center electrode and a ground electrode facing the side surface of the center electrode.
Figure 7:
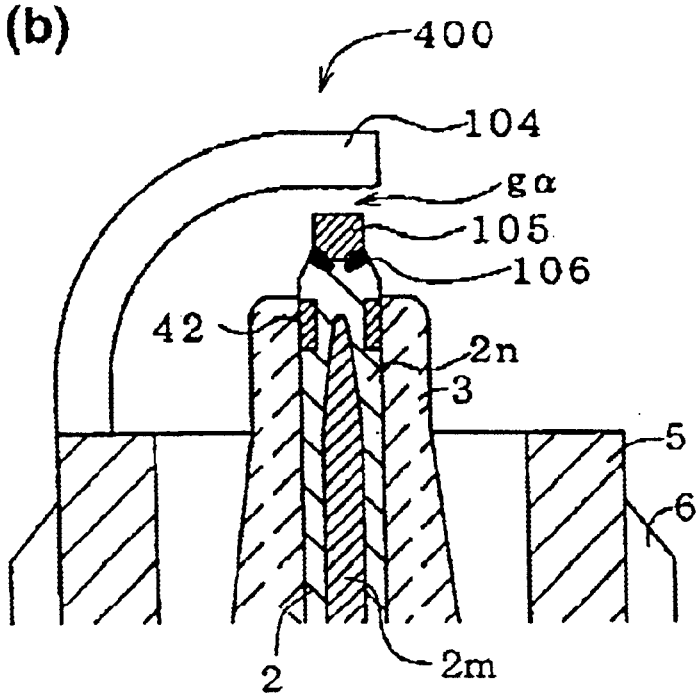

All of the spark plugs of the above-described embodiments employ semi-creeping ground electrodes 4. However, the present invention also encompasses an embodiment in which the tip end surfaces of some ground electrodes 4, among a plurality of ground electrodes, do not face the side surface of the center electrode 2. One example of such a spark plug is shown in FIG. 7(*a*) (front view) and FIG. 7(*b*) (side view). As in the case of the spark plug 300 of FIG. 6 and other spark plugs, in a spark discharge gap 400 of the present embodiment, a cylindrical metallic shell 5 is provided to surround the insulator 3. Further, a plurality of ground electrodes 4 and 104 are provided such that their base ends are welded to an end portion of the metallic shell 5; and their tip end portions are bent toward the center electrode 2. One of these ground electrodes; i.e., the ground electrode 104, is disposed such that its side surface faces the tip end surface of the center electrode 2 in substantially parallel thereto. Meanwhile, at least one of the remaining ground electrodes 4 (two ground electrodes 4 in the present embodiment) are disposed such that their end surfaces face the side surface of the center electrode 2. That is, one of the plurality of ground electrodes 4 and 104 serves as a parallel ground electrode which faces the tip end surface 2*a* of the center electrode 2 in substantially parallel thereto, to thereby form a parallel aerial discharge gap gα.

In the above-described configuration, a parallel aerial discharge gap gα as in the case of a parallel electrode spark plug is formed between the side surface of the ground electrode 104 and the tip end surface of the center electrode 2; and semi-creeping discharge gaps gβ as in the case of a multielectrode spark plug are formed between the tip end surfaces of the ground electrodes 4 and the side surface of the center electrode 2. When the size of the gap gα is rendered greater than that of the gap gβ, sparks are generated more easily at the gap gα in an ordinary state; and when the tip end surface 3*e* of the insulator 3 is contaminated, sparks are generated more easily at the gap gβ. Since the degree of concentration of sparks at the gap gα having a configuration similar to that of a parallel electrode spark plug is high (especially in the case of voltage application such that the center electrode 2 assumes a negative polarity), ignition performance can be improved. In such a case as well, the difference (d−D) between the outer diameter D of the center electrode and the diameter d of the through hole, into which the center electrode is inserted, is preferably 0.07 mm or more as measured at a position separated from the tip end of the insulator by 5 mm as measured along the axial direction. Notably, in the present embodiment, the ground electrodes 4 are disposed to face the side surface of the center electrode, with the tip end portion of the insulator 3 being interposed therebetween. That is, at the gaps gβ, semi-creeping spark discharge occurs as in the case of the spark plug 1 of, for example, FIG. 2.

It is not necessarily the case that no spark discharge occurs at the gap gβ in an ordinary state; in some cases, spark discharge of a relatively high level occurs even when the insulator 3 has not been contaminated. In such a case, sparks are produced at the gap gβ by means of semi-creeping spark discharge occurring at the tip end surface 3*e* of the insulator 3, and therefore, there must be taken into account the consumption of the side surface of the tip end portion of the center electrode 2 at a position corresponding to the tip end surface 3*e* of the insulator 3. In view of the above, at the position corresponding to the tip end surface 3*e* of the insulator 3, the diameter D2' of the center electrode 2 is preferably set to 2.0 mm or greater. Increasing the diameter D2' at that position is advantageous in suppressing consumption, because discharge passages can be distributed easily.

Notably, a consumption-resistant portion 105 made of a metallic material containing at least one of Ir, Pt and Ru as a predominant component, or a composite material containing the metallic material as a predominant component, is fixed to the tip end portion of the center electrode 2 by means of an annular welding portion 106, which is formed through, for example, laser welding. A consumption-resistant portion 42 similar to that shown in FIG. 6(*b*) is formed at the outer circumferential surface of the center electrode 2. Further, a heat-radiation-promoting metal portion 2*m* made of Cu or a Cu alloy is formed within the center electrode 2. As shown in FIG. 9(*b*), at least a portion of the welding portion 106 may be retracted inward from the tip end surface 3*e* of the insulator 3 with respect to the axial direction thereof.

Figure 8:
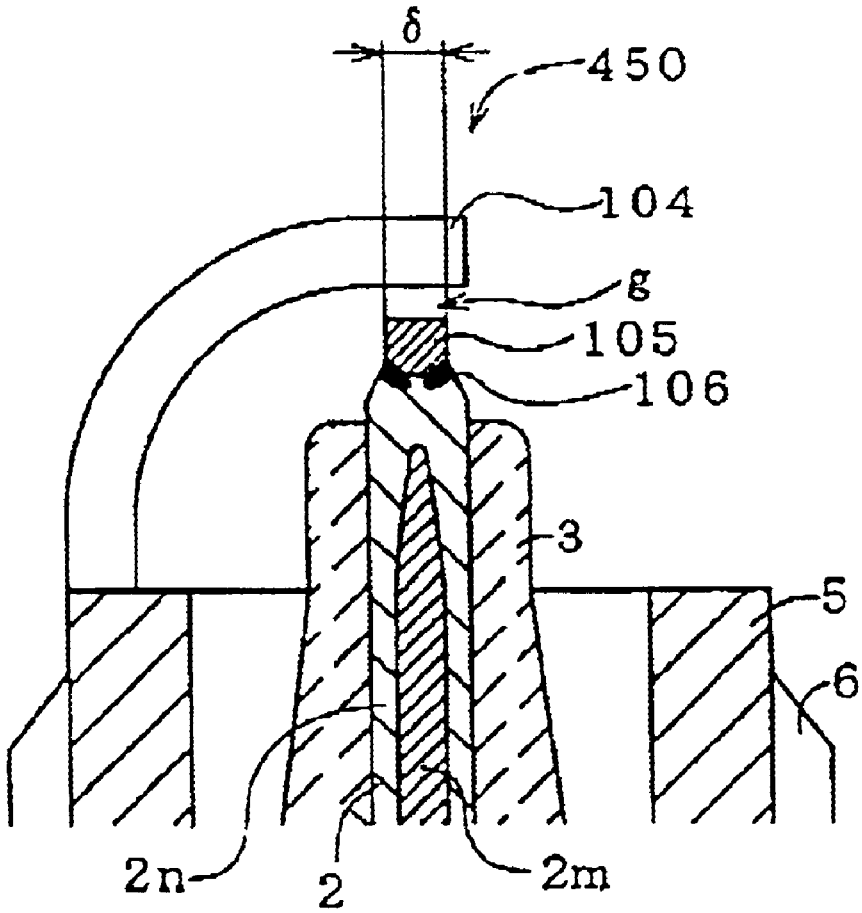
FIG. 8 is a main-portion longitudinal sectional view showing an example in which the present invention is applied to a parallel electrode spark plug.

Moreover, the present invention can be applied not only to the above-described creeping discharge spark plugs but also to parallel electrode spark plugs. A spark plug 450 shown in FIG. 8 is an example of the parallel electrode spark plugs and has a configuration corresponding to that of the spark plug 400 shown in FIG. 7(*b*), except that the side-surface-facing-type ground electrodes 4 are omitted (the same structural elements as those of the spark plug 400 are denoted by the same reference numerals). Since the outer circumferential surface of the center electrode 2 does not serve as a discharge surface, the consumption-resistant portion 42 of the spark plug 400 is not provided. Since the electrode base material 2*n* of the center electrode 2 is formed of the above-described material containing Cr and Fe, in the spark plug 450 as well, a layer having the same composition of the above-mentioned corrosion suppression layer is formed on the tip end surface 3*e* of the insulator 3. In the case of parallel electrode spark plugs, channeling of the insulator is not a serious problem. However, when a component which contributes to formation of the above-described layer is incorporated into the electrode base material, both excellent consumption resistant of the electrode and excellent separation resistance of the noble-metal chip can be attained. That is, since the electrode base material containing the above-described component has a high coefficient of thermal conductivity, transfer of heat from the electrode is improved, and thus the temperature of the electrode itself decreases, so that consumption resistance is enhanced. However, when the coefficient of thermal conductivity becomes excessively high, the weldability of the noble-metal chip is deteriorated. In particular, when the diameter of the chip increases, problems such as incomplete welding between the chip and the base material portion, separation of the chip, and anomalous consumption tend to occur. However, the material employed in the present invention can avoid such problems, and enables attainment of both the above-described properties. Therefore, consumption of the consumption-resistant portion 105 can be suppressed, so that the service life of the spark plug can be increased.

Notably, in the parallel electrode spark plug, when consumption of the ground electrode 104 proceeds excessively, the spark discharge gap g is widened, and the above-described lateral sparks may be produced in some cases. Especially, when, due to sputtering of the electrode base material 2*n* of the center electrode 2, a large amount of a reaction product containing a NTC semiconductor oxide is deposited on the surface of the insulator 3, the resistivity of the surface of the insulator 3 decreases, so that lateral sparks are likely to be produced. In such a case, the amount of the NTC semiconductor oxide contained in the reaction product is preferably adjusted such that the resistivity of the reaction product does not becomes excessively high. In view of this, the Ni alloy which constitutes the electrode base material 2*n* is preferably prepared to contain NTC elements as secondary components in a total amount of 10% by mass or less.

Notably, in the spark plug 400 of FIG. 7 and the spark plug 450 of FIG. 8, the consumption-resistant portion 105 is formed as follows. A disc-shaped chip is placed on the tip end surface of the center electrode 2; and an all-round laser welding portion (hereinafter may be referred to as simply a "welding portion") 106 is formed along the outer edge portion of the junction surface thereof by means of laser welding. When the electrode base material 2*n* of the center electrode 2 is made of an alloy containing Ni in an amount of 80% by mass or more and Fe and Cr in a total amount of 2 to 9% by mass, the weldability of a chip containing Pt, Ir, or Ru as a predominant component tends to deteriorate slightly, and in some cases, the consumption-resistant portion 105 comes off easily. In such a case, through decreasing the diameter δ of a chip to be welded to 0.8 mm or less, problems, such as welding failure, can be mitigated, so that the consumption-resistant portion 105 hardly comes off. However, when the diameter δ of the chip is less than 0.3 mm, formation of the consumption-resistant portion 105 by welding becomes difficult. Therefore, use of a chip whose diameter δ is not less than 0.3 mm is desirable.

Notably, when the chip is formed of an Ir-base metallic material, the chip is desirably fixed by means of laser welding as described above, because the Ir-base metallic material has a high melting point. However, when the chip is formed of a Pt-base metallic material or an Ru-base metallic material, the chip may be fixed by means of resistance welding or electron-beam welding, because the Pt-base or Ru-base metallic material has a melting point lower than that of the Ir-base metallic material.

The invention will next be illustrated in further detail by the following Examples. However, the present invention should not be construed to be limited thereto.

EXAMPLE 1

In order to confirm the effects of the present invention, the following experiment was performed using the spark plug shown in FIGS. 1 and 2. The sizes of the first gap g1 and the second gap g2 (shown in FIG. 2) were set to 1.6 mm and 0.6 mm, respectively. Further, the distance E was set to 0.5 mm, and the distance t was set to 1.2. The diameter $D_2$ of the tip end portion 2*a* of the center electrode 2 was set to 2.0 mm; and the diameter $D_1$ of the base end portion 2*c* of the center electrode 2 was set to 2.1 mm. The tip end position of the heat-radiation-promoting metal portion 2*m* was set to −0.5 mm relative to the tip end surface 3*e* of the insulator 3 serving as a reference position, in consideration of the difference in expansion between the electrode base material 2*n* and the heat-radiation-promoting metal portion 2*m* due to heat from combustion gas. Further, the difference $d-D_1$ was set to 0.08 mm. Samples of the spark plug were fabricated, while metallic materials having different compositions shown in Table 1 were used as the electrode base material of the center electrode 2 and the ground electrodes 4. The coefficients of thermal conductivity of the metallic materials having the respective compositions were measured by a laser flash method. The insulator 3 was formed of an alumina sintered body.

In order to investigate channeling resistance and electrode consumption of these sample spark plugs, the sample spark plugs were attached to a four-cylinder gasoline engine (displacement: 1800 cc), which was then operated in a full-throttle state (engine speed: 6000 rpm) for 200 hours. Subsequently, the depth of a channeling groove formed on the surface of the insulator 3 was measured through observation under a scanning electron microscope (Notably, voltage was applied intermittently at a frequency of 60 Hz in such a polarity that the center electrode assumed a negative polarity). The formed channeling groove was evaluated according to the following criteria: minor (O): depth of groove was less than 0.2 mm; intermediate (Δ): depth of groove was 0.2 to 0.4 mm; and severe (X): depth of groove was greater than 0.4 mm. Further, consumption of the electrode was evaluated according to the following criteria: minor (O): reduction of electrode diameter from the initial diameter was less than 10%; intermediate (Δ): reduction of electrode diameter from the initial diameter was at least 10 but less than 30%; and severe (X): reduction of electrode diameter from the initial diameter was at least 30%.

TABLE 1

| | Composition (% by mass) | | | | | | | Coefficient of thermal | Channeling | Degree of electrode |
|---|---|---|---|---|---|---|---|---|---|---|
| | Cr | Fe | Cu | Si | Mn | C | Ni | conductivity | resistance | consumption |
| Material A | 24 | 9 | — | 1.5 | 2 | — | Balance | 12 W/m · K | ○ | ラ |
| Material B | 16 | 8 | — | 0.3 | 0.7 | 0.02 | Balance | 15 W/m · K | ○ | ラ |
| Material C | 8 | 5 | — | 1.5 | 2 | — | Balance | 17 W/m · K | ○ | Δ |
| Material D | 3 | 5 | — | 1.5 | 2 | — | Balance | 20 W/m · K | ○ | Δ |
| Material E | 5 | 1.5 | — | 1.5 | 2 | — | Balance | 23 W/m · K | ○ | ○ |
| Material F | 3 | 2.5 | — | 1.5 | 2 | — | Balance | 25 W/m · K | ○ | ○ |
| Material G | 2.5 | 2 | — | 1.5 | 2 | — | Balance | 28 W/m · K | ○ | ○ |
| Material H | 1.5 | 1.5 | — | 1.5 | 2 | — | Balance | 30 W/m · K | Δ | ○ |
| Material I | 3.0 | — | — | 1.5 | 2 | — | Balance | 30 W/m · K | Δ | ○ |
| Material J | — | 3.0 | — | 1.5 | 2 | — | Balance | 30 W/m · K | Δ | ○ |
| Material K | — | — | 3.0 | 1.5 | 2 | — | Balance | 30 W/m · K | Δ | ○ |
| Material M | 1.5 | — | — | 1.5 | 2 | — | Balance | 35 W/m · K | x | ○ |
| Material N | 1 | — | — | 1.5 | 2 | — | Balance | 40 W/m · K | ラ | ○ |
| Material O | — | — | — | — | — | — | 100 | 85 W/m · K | ラ | ○ |

As is apparent from the above results, spark plugs having the metallic composition of the electrode base material adjusted such that the coefficient of thermal conductivity of the electrode base material falls within the range of 17 to 30 W/m·K provide good results in terms of both channeling resistance and electrode consumption resistance.

EXAMPLE 2

Samples of the same spark plug as that of Example 1 were fabricated using material C in Table 1, while the value of E was adjusted to various values within the range of 0 to 0.8 mm. The thus-fabricated sample spark plugs were evaluated for channeling resistance in the same manner as in Example 1. Table 2 shows the results of the evaluation.

TABLE 2

| Dimension of overlap portion E (mm) | 0 | 0.2 | 0.5 | 0.8 |
|---|---|---|---|---|
| Evaluation of channeling | ラ | O | O | O |

As is apparent from the results, high channeling resistance can be obtained when the value of E is set to 0.2 mm or more.

EXAMPLE 3

In order to confirm the effects of the present invention, the following experiment was performed using the parallel electrode spark plug shown in FIG. 5. The size of the spark discharge gap g (shown in FIG. 8) was set to 0.6 mm. The consumption-resistant portion 105 was formed through laser-welding of an Ir—Pt (5% by mass) chip having a diameter of 0.8 mm and a height of 0.6 mm. Samples of the spark plug were fabricated, while metallic materials having different compositions shown in Table 3 were used as the electrode base material of the center electrode 2 and the ground electrode 4. In order to investigate the separation resistance of the consumption-resistant portion 105 of each sample spark plug, the sample spark plugs were attached to a six-cylinder gasoline engine (displacement: 2000 cc), which was then subjected to heating/cooling cycles for 200 hours. In each cycle, the engine was operated in a full-throttle state (engine speed: 5000 rpm) for 1 minute, and then operated in an idle state for 1 minute. Subsequently, each sample was visually checked to evaluate separation of the chip, according to the following criteria: minor (O): no change was observed at the welding portion of the consumption-resistant portion 105; intermediate (Δ): slight separation was observed at the welding portion; and severe (X): the consumption-resistant portion 105 was separated.

Moreover, in order to investigate the consumption resistance of the consumption-resistant portion 105 of each sample spark plug, the sample spark plugs were attached to a four-cylinder gasoline engine (displacement: 1800 cc), which was then operated in a full-throttle state (engine speed: 6000 rpm) for 200 hours. Subsequently, the consumption resistance of the consumption-resistant portion 105 was evaluated on the basis of an increase in the size of the gap, according to the following criteria: minor (O): gap increase was less than 0.02 mm; intermediate (Δ): gap increase was at least 0.02 mm but less than 0.04 mm; and severe (X): gap increase was at least 0.04 mm.

Table 3 shows the results of the experiment.

TABLE 3

| | Composition (% by mass) | | | | | | Coefficient of thermal | Noble metal chip | |
|---|---|---|---|---|---|---|---|---|---|
| | Cr | Fe | Si | Mn | C | Ni | conductivity | Separation resistance | Consumption resistance |
| Material A | 24 | 9 | 1.5 | 2 | — | Balance | 12 W/m · K | ○ | ラ |
| Material B | 16 | 8 | 0.3 | 0.7 | 0.02 | Balance | 15 W/m · K | ○ | ラ |
| Material C | 8 | 5 | 1.5 | 2 | — | Balance | 17 W/m · K | ○ | Δ |
| Material D | 3 | 5 | 1.5 | 2 | — | Balance | 20 W/m · K | ○ | ○ |
| Material E | 5 | 1.5 | 1.5 | 2 | — | Balance | 23 W/m · K | ○ | ○ |
| Material F | 3 | 2.5 | 1.5 | 2 | — | Balance | 25 W/m · K | ○ | ○ |
| Material G | 2.5 | 2 | 1.5 | 2 | — | Balance | 28 W/m · K | Δ | ○ |

TABLE 3-continued

| | Composition (% by mass) | | | | | | Coefficient of thermal conductivity | Noble metal chip | |
|---|---|---|---|---|---|---|---|---|---|
| | Cr | Fe | Si | Mn | C | Ni | | Separation resistance | Consumption resistance |
| Material H | 1.5 | 1.5 | 1.5 | 2 | — | Balance | 30 W/m · K | Δ | ○ |
| Material I | — | 1.5 | 1.5 | 2 | — | Balance | 32 W/m · K | ラ | ○ |
| Material J | 1.5 | — | 1.5 | 2 | — | Balance | 35 W/m · K | ラ | ○ |
| Material K | 1 | — | 1.5 | 2 | — | Balance | 40 W/m · K | ラ | ○ |
| Material L | — | — | — | — | — | 100 | 85 W/m · K | ラ | ○ |

As is apparent form the above results, spark plugs having the metallic composition of the electrode base material adjusted such that the coefficient of thermal conductivity of the electrode base material falls within the range of 17 to 30 W/m·K provide good results in terms of both durability against separation and consumption resistance of the consumption-resistant portion formed of noble metal.

EXAMPLE 4

In order to confirm the effects of the present invention, the following experiment was performed using the spark plug shown in FIG. 7(*a*). The sizes of the parallel aerial discharge gap gα and the semi-creeping discharge gap gβ (shown in FIG. 7(*a*)) were set to 0.9 mm and 0.6 mm, respectively. The consumption-resistant portion 105 was formed by laser-welding an Ir—Pt (5% by mass) chip having a diameter of 0.8 mm and a height of 0.6 mm. Samples of the spark plug were fabricated, while metallic materials having different compositions shown in Tables 4 to 12 were used as the electrode base material of the center electrode 2 and the ground electrodes 4 and 104. The coefficients of thermal conductivity of the metallic materials having the respective compositions were measured by a laser flash method. The insulator 3 was formed of an alumina sintered body.

The channeling resistance and electrode consumption of each sample spark plug were evaluated by performing the same experiment as that performed in Example 1. Further, the separation resistance and consumption resistance of the consumption-resistant portion 105 were evaluated by performing the same experiment as that performed in Example 2. Tables 4 to 12 show the results of these experiments.

TABLE 4

| | Composition (% by mass) | | | | | | | Coefficient of thermal conductivity | Channeling resistance | Electrode consumption | Noble metal chip | |
|---|---|---|---|---|---|---|---|---|---|---|---|---|
| | Cr | Fe | Cu | Si | Mn | C | Ni | | | | Separation resistance | Consumption resistance |
| Material A | 24 | 9 | — | 1.5 | 2 | — | Balance | 12 W/m · K | ○ | ラ | ○ | ラ |
| Material B | 16 | 8 | — | 0.3 | 0.7 | 0.02 | Balance | 15 W/m · K | ○ | ラ | ○ | ラ |
| Material C | 8 | 5 | — | 1.5 | 2 | — | Balance | 17 W/m · K | ○ | Δ | ○ | Δ |
| Material D | 3 | 5 | — | 1.5 | 2 | — | Balance | 20 W/m · K | ○ | Δ | ○ | ○ |
| Material E | 5 | 1.5 | — | 1.5 | 2 | — | Balance | 23 W/m · K | ○ | ○ | ○ | ○ |
| Material F | 3 | 2.5 | — | 1.5 | 2 | — | Balance | 25 W/m · K | ○ | ○ | ○ | ○ |
| Material G | 2.5 | 2 | — | 1.5 | 2 | — | Balance | 28 W/m · K | ○ | ○ | Δ | ○ |
| Material H | 1.5 | 1.5 | — | 1.5 | 2 | — | Balance | 30 W/m · K | Δ | ○ | Δ | ○ |
| Material I | 3.0 | — | — | 1.5 | 2 | — | Balance | 30 W/m · K | Δ | ○ | Δ | ○ |
| Material J | — | 3.0 | — | 1.5 | 2 | — | Balance | 30 W/m · K | Δ | ○ | Δ | ○ |
| Material K | — | — | 3.0 | 1.5 | 2 | — | Balance | 30 W/m · K | Δ | ○ | Δ | ○ |
| Material M | 1.5 | — | — | 1.5 | 2 | — | Balance | 35 W/m · K | ラ | ○ | ラ | ○ |
| Material N | 1 | — | — | 1.5 | 2 | — | Balance | 40 W/m · K | ラ | ○ | ラ | ○ |
| Material O | — | — | — | — | — | — | 100 | 85 W/m · K | ラ | ○ | ラ | ○ |

TABLE 5

| | Composition (% by mass) | | | | | | Coefficient of thermal conductivity | Channeling resistance | Electrode consumption | Noble metal chip | |
|---|---|---|---|---|---|---|---|---|---|---|---|
| | Cr | Ru | Si | Mn | C | Ni | | | | Separation resistance | Consumption resistance |
| Material M | 5 | 2 | 1.5 | 2 | — | Balance | 18 W/m · K | ○ | Δ | ○ | Δ |

TABLE 6

| | Composition (% by mass) | | | | | | Coefficient of thermal conductivity | Channeling resistance | Electrode consumption | Noble metal chip Separation resistance | Noble metal chip Consumption resistance |
|---|---|---|---|---|---|---|---|---|---|---|---|
| | Cr | Zn | Si | Mn | C | Ni | | | | | |
| Material N | 5 | 2 | 1.5 | 2 | — | Balance | 21 W/m · K | ○ | ○ | ○ | ○ |

TABLE 7

| | Composition (% by mass) | | | | | | Coefficient of thermal conductivity | Channeling resistance | Electrode consumption | Noble metal chip Separation resistance | Noble metal chip Consumption resistance |
|---|---|---|---|---|---|---|---|---|---|---|---|
| | Cr | V | Si | Mn | C | Ni | | | | | |
| Material O | 5 | 2 | 1.5 | 2 | — | Balance | 22 W/m · K | ○ | ○ | ○ | ○ |

TABLE 8

| | Composition (% by mass) | | | | | | Coefficient of thermal conductivity | Channeling resistance | Electrode consumption | Noble metal chip Separation resistance | Noble metal chip Consumption resistance |
|---|---|---|---|---|---|---|---|---|---|---|---|
| | Cr | Co | Si | Mn | C | Ni | | | | | |
| Material P | 5 | 2 | 1.5 | 2 | — | Balance | 23 W/m · K | ○ | ○ | ○ | ○ |

TABLE 9

| | Composition (% by mass) | | | | | | Coefficient of thermal conductivity | Channeling resistance | Electrode consumption | Noble metal chip Separation resistance | Noble metal chip Consumption resistance |
|---|---|---|---|---|---|---|---|---|---|---|---|
| | Cr | Nb | Si | Mn | C | Ni | | | | | |
| Material Q | 5 | 2 | 1.5 | 2 | — | Balance | 20 W/m · K | ○ | Δ | ○ | ○ |

TABLE 10

| | Composition (% by mass) | | | | | | Coefficient of thermal conductivity | Channeling resistance | Electrode consumption | Noble metal chip Separation resistance | Noble metal chip Consumption resistance |
|---|---|---|---|---|---|---|---|---|---|---|---|
| | Cr | Ta | Si | Mn | C | Ni | | | | | |
| Material R | 5 | 2 | 1.5 | 2 | — | Balance | 19 W/m · K | ○ | Δ | ○ | ○ |

TABLE 11

| | Composition (% by mass) | | | | | | Coefficient of thermal conductivity | Channeling resistance | Electrode consumption | Noble metal chip Separation resistance | Noble metal chip Consumption resistance |
|---|---|---|---|---|---|---|---|---|---|---|---|
| | Cr | Ti | Si | Mn | C | Ni | | | | | |
| Material S | 5 | 2 | 1.5 | 2 | — | Balance | 21 W/m · K | ○ | Δ | ○ | ○ |

TABLE 12

| | Composition (% by mass) | | | | | | Coefficient of thermal conductivity | Channeling resistance | Electrode consumption | Noble metal chip | |
|---|---|---|---|---|---|---|---|---|---|---|---|
| | Cr | Cu | Si | Mn | C | Ni | | | | Separation resistance | Consumption resistance |
| Material S | 5 | 2 | 1.5 | 2 | — | Balance | 23 W/m · K | ○ | Δ | ○ | ○ |

As is apparent from the above results, spark plugs having the metallic composition of the electrode base material adjusted such that the coefficient of thermal conductivity of the electrode base material falls within the range of 17 to 30 W/m·K provide good results in terms of channeling resistance and electrode consumption, as well as in durability against separation and consumption resistance of the consumption-resistant portion formed of noble metal.

It should further be apparent to those skilled in the art that various changes in form and detail of the invention as shown and described above may be made. It is intended that such changes be included within the spirit and scope of the claims appended hereto.

This application is based on Japanese Patent Application Nos. 2000-282396 filed Sep. 18, 2000 and 2001-220531 filed Jul. 19, 2001, the disclosures of which are incorporated herein by reference in their entirety.

What is claimed is:

1. A spark plug comprising:

a center electrode;

an insulator surrounding the center electrode; and a ground electrode positioned relative to a tip end portion of the insulator and a tip end portion of the center electrode such that a spark discharge gap is formed between the ground electrode and the tip end portion of the center electrode, and creeping spark discharge along a surface of the tip end portion of the insulator can occur at the spark discharge gap, wherein an electrode base material which forms at least a surface layer portion of the center electrode is made of an Ni alloy having a coefficient of thermal conductivity of 17 to 30 W/m-K, the Ni alloy containing Ni as a predominant component and an element, as a secondary component, which element can form an oxide semiconductor having a resistivity of negative temperature coefficient, wherein the Ni alloy constituting the electrode base material contains, as the secondary component, Fe in an amount of 1% by mass or more and Cr in an amount of 1.5% by mass or more, such that the total amount of Fe and Cr is 2.5 to 9% by mass.

2. The spark plug as claimed in claim 1, wherein two or more ground electrodes are disposed around the center electrode.

3. The spark plug as claimed in claim 2, wherein a plurality of ground electrodes are disposed around the center electrode; and at least one ground electrode among them is a semi-creeping ground electrode which is disposed such that its end surface faces a side surface of the center electrode, while at least a portion of the tip end portion of the insulator is interposed therebetween to thereby form a semi-creeping discharge gap between the end surface of the semi-creeping ground electrode and the side surface of the center electrode.

4. The spark plug as claimed in claim 3, wherein a distance of overlap between the tip end surface of the semi-creeping ground electrode and the side surface of the tip end portion of the insulator along the axis of the center electrode is 0.2 mm or more.

5. The spark plug as claimed in claim 3, wherein one of the plurality of ground electrodes is a parallel ground electrode which is disposed such that a side surface of a tip end portion of the ground electrode faces, in parallel, the tip end surface of the center electrode to thereby form a parallel aerial discharge gap.

6. The spark plug as claimed in claim 1, wherein the tip end portion of the center electrode projects from the insulator, and a cylindrical metallic shell surrounds the insulator; and a base portion of a ground electrode is welded to an end portion of the metallic shell, and a tip end portion of the ground electrodes is bent toward the center electrode such that an end surface of the ground electrode faces a side surface of the projecting tip end portion of the center electrode to thereby form a first gap, and an inner surface of the tip end portion of the ground electrode faces the tip end surface of the insulator to thereby form a second gap, which is smaller than the first gap.

7. The spark plug as claimed in claim 1, wherein the Ni alloy constituting the electrode base material contains at least one of Cr, Fe and Cu, as the secondary component.

8. The spark plug as claimed in claim 7, wherein the Ni alloy constituting the electrode base material contains Cr in an amount of 1.5 to 9% by mass, as the secondary component.

9. The spark plug as claimed in claim 1, wherein the Ni alloy constituting the electrode base material contains Fe in an amount of 1 to 5% by mass, as the secondary component.

10. The spark plug as claimed in claim 1, wherein the Ni alloy constituting the electrode base material contains Cr in an amount of 2 to 5% by mass, as the secondary component.

11. The spark plug as claimed in claim 1, wherein the Ni alloy contains Cr in an amount greater than that of Fe.

12. The spark plug as claimed in claim 1, wherein the Ni alloy contains, as the secondary component, at least one element selected from the group consisting of Ru, Zn, V, Co, Nb, Ta and Ti.

13. The spark plug as claimed in claim 1, wherein the Ni alloy constituting the electrode base material contains Ni in an amount of 80% by mass or more.

14. The spark plug as claimed in claim 1, wherein the Ni alloy constituting the electrode base material contains the secondary component in a total amount of 1.5 to 10% by mass.

15. The spark plug as claimed in claim 1, wherein the center electrode has a surface layer portion formed of an electrode base material made of Ni or an Ni alloy; and a heat-radiation-promoting metal portion made of a material having a coefficient of thermal conductivity higher than that of the electrode base material is embedded within the electrode base material and extends along a longitudinal direction of the electrode.

16. The spark plug as claimed in claim 15, wherein the heat-radiation-promoting metal portion is made of Cu or a Cu alloy.

17. A spark plug comprising:

a center electrode having, at its tip end portion, a consumption-resistant portion made of a nobel metal or a composite material containing a noble metal as a predominant component;

an insulator surrounding the center electrode; and a ground electrode disposed such that a side surface of a tip end portion of the ground electrode faces, in parallel, a tip end surface of the center electrode, to thereby form a parallel aerial discharge gap, wherein an electrode base material, which forms at least a surface layer portion of the center electrode, is formed of an Ni alloy which contains Ni as a predominant component and Cr in an amount of 1.5 to 9% by mass and Fe in an amount of 1 to 5% by mass as a secondary component, and has a coefficient of thermal conductivity of 17 to 30 W/m-K.

18. The spark plug as claimed in claim 17, wherein the Ni alloy constituting the electrode base material contains Cr in an amount of 2 to 5% by mass, as the secondary component.

19. The spark plug as claimed in claim 17, wherein the Ni alloy constituting the electrode base material contains, as the secondary component, Fe in an amount of 1% by mass or more and Cr in an amount of 1.5% by mass or more, such that the total amount of Fe and Cr is 2.5 to 9% by mass.

20. The spark plug as claimed in claim 17, wherein the Ni alloy contains Cr in an amount greater than that of Fe.

21. The spark plug as claimed in claim 17, wheein the Ni alloy contains, as the secondary component, at least one element selected from the group consisting of Ru, Zn, V, Co, Nb, Ta and Ti.

22. The spark plug as claimed in claim 17, wherein the Ni alloy constituting the electrode base material contains Ni in an amount of 80% by mass or more.

23. The spark plug as claimed in claim 17, wherein the Ni alloy constituting the elctrode base material contains the secondary component in a total amount of 1.5 to 10% by mass.

24. The spark plug as claimed in claim 17, wherein the center electrode has a surface layer portion formed of an electrode base material made of Ni or an Ni alloy; and a heat-radiation-promoting metal portion made of a material having a coefficient of thermal conductivity higher than that of the electrode base material is embedded within the electrode base material and extends along a longitudinal direction of the electrode.

25. The spark plug as claimed in claim 24, wherein the heat-radiation-promoting metal is made of Cu or a Cu alloy.

26. A spark plug comprising:

a center electrode;

an insulator surrounding the center electrode; and a ground electrode positioned relative to a tip end portion of the insulator and a tip end portion of the center electrode such that a spark discharge gap is formed between the ground electrode and the tip end portion of the center electrode, and creeping spark discharge along a surface of the tip end portion of the insulator can occur at the spark discharge gap, wherein an electrode base material which forms at least a surface layer portion of the center electrode is made of an Ni alloy containing Ni as a predominant component and further containing, as a secondary component, an element selected from the group consisting of Ru, Zn, V, Co, Nb, Ta and Ti, wherein the Ni alloy constituting the electrode base material contains Ni in an amount of 80% by mass or more.

27. The spark plug as claimed in claim 17, wherein the Ni alloy constituting the electrode base material contains the secondary component in a total amount of 1.5 to 10% by mass.

28. The spark plug as claimed in claim 17, wherein the center electrode has a surface layer portion formed of an electrode base material made of Ni or an Ni alloy; and a heat-radiation-promoting metal portion made of a material having a coefficient of thermal conductivity higher than that of the electrode base material is embedded within the electrode base material and extends along a longitudinal direction of the electrode.

29. The spark plug as claimed in claim 28, wherein the heat-radiation-promoting metal portion is made of Cu or a Cu alloy.

30. A spark plug comprising:

a center electrode having, at its tip end portion, a consumption-resistant portion made of a noble metal or a composite material containing a noble metal as a predominant component;

an insulator surrounding the center electrode; and a ground electrode disposed such that a side surface of a tip end portion of the ground electrode faces, in parallel, a tip end surface of the center electrode, to thereby form a parallel aerial discharge gap, wherein an electrode base material, which forms at least a surface layer portion of the center electrode, is formed of an Ni alloy which contains Ni as a predominant component and Cr in an amount of 1.5 to 9% by mass as a secondary component, and has a coefficient of thermal conductivity of 17 to 30 W/m-K, wherein the Ni alloy contains Cr in an amount greater than that of Fe.

31. A spark plug comprising:

a center electrode having an outer circumferential surface;

an insulator surrounding the center electrode; and a ground electrode positioned relative to a tip end portion of the insulator and a tip end portion of the center electrode such that a spark discharge gap is formed between the ground electrode and the tip end portion of the center electrode, and creeping spark discharge along a surface of the tip end portion of the insulator can occur at the spark discharge gap, wherein an electrode base material which forms at least a surface layer portion of the center electrode is made of an Ni alloy having a coefficient of thermal conductivity of 17 to 30 W/m-K, the Ni alloy containing Ni as a predominant component and an element, as a secondary component, which element can form an oxide semiconductor having a resistivity of negative temperature coefficient, wherein a consumption-resistant portion is formed on the outer circumferential surface of the center electrode, and the consumption-resistant portion is formed so as not to cross regions corresponding to the tip end of the insulator with respect to the axis of the center electrode.

32. A spark plug comprising:

a center electrode having an outer circumferential surface;

an insulator having a through hole surrounding the center electrode; and a ground electrode positioned relative to a tip end portion of the insulator and a tip end portion of the center electrode such that a spark discharge gap is formed between the ground electrode and the tip end portion of the center electrode, and creeping spark dischrge along a surface of the tip end portion of the insulator can occur at the spark discharge gap, wherein an electrode base material which forms at least a surface layer portion of the center electrode is made of an Ni alloy having a coefficient of thermal conductivity of 17 to 30 W/m-K, the Ni alloy containing Ni as a predominant component and an element, as a secondary component, which element can form an oxide semiconductor having a resistivity of negative temperature coefficient, wherein a consumption-resistant portion is formed on the outer circumferential surface of the center electrode, and the whole consumption-resistant portion is accommodated in the through hole of the insulator.

* * * * *